US006873348B1

(12) United States Patent
Isono et al.

(10) Patent No.: US 6,873,348 B1
(45) Date of Patent: Mar. 29, 2005

(54) PRINTING METHOD AND PRINTING SYSTEM AND PRINTING APPARATUS

(75) Inventors: Hajime Isono, Yamanashi-ken (JP); Takehito Kobayashi, Yamanashi-ken (JP)

(73) Assignee: Nisca Corporation, Yamanashi-ken (JP)

( * ) Notice: Subject to any disclaimer, the term of this patent is extended or adjusted under 35 U.S.C. 154(b) by 268 days.

(21) Appl. No.: 10/349,908

(22) Filed: Jan. 24, 2003

(30) Foreign Application Priority Data

Jan. 29, 2002 (JP) ..... 2002-019605
Jan. 29, 2002 (JP) ..... 2002-019704

(51) Int. Cl.[7] ..... B41J 15/16; B41J 2/32
(52) U.S. Cl. ..... 347/213; 347/171
(58) Field of Search ..... 347/171, 213, 347/217; 400/120.01; 235/375, 449; 700/235

(56) References Cited

U.S. PATENT DOCUMENTS 5,229,586 A * 7/1993 Ishii ..... 235/375
5,768,143 A * 6/1998 Fujimoto ..... 700/235
5,959,278 A 9/1999 Kobayashi et al. ..... 235/449
6,377,291 B2 * 4/2002 Andoh et al. ..... 347/213
6,664,993 B2 * 12/2003 Isono ..... 347/213

FOREIGN PATENT DOCUMENTS

JP 09-131930 5/1997
JP 2870574 1/1999

* cited by examiner

*Primary Examiner*—K. Feggins
(74) *Attorney, Agent, or Firm*—Manabu Kanesaka

(57) ABSTRACT

In direct transfer, a card is transported to an image forming portion, same size, reduced or gradation corrected image data is used for forming an image to the entire surface of at least one side of a card. In indirect transfer, intermediate transfer film is transported to an image forming portion, and same size, reduced or gradation corrected image data is used to form images on the intermediate transfer film, then while transporting the intermediate transfer film to a transfer portion, a card is also transported to the transfer portion where images formed on the intermediate transfer film are transferred to the entire area of at least one side of the card. Image data size is varied. By switching between a direct transfer method and an indirect transfer method makes either transfer method applicable thereby improving printer user convenience, enables the forming of beautiful printing to the entire print surface, lowers running costs and enables high applicability of the printing system.

29 Claims, 24 Drawing Sheets

PRINTING METHOD AND PRINTING SYSTEM AND PRINTING APPARATUS

BACKGROUND OF THE INVENTION

1. Field of the Invention

This invention relates to a printing method, printing system and printing apparatus for printing a variety of information such as images and characters to a recording medium, such as a card, and more particularly to a printing method, printing system and printing apparatus that are capable of switching printing methods to print information to the entire surface of the recording medium.

2. Description of the Related Art

Conventionally, thermal transfer method printing apparatuses that record the desired images and characters by thermally transferring using a thermal head via a thermal transfer film to a recording medium are used to create card shaped recording medium, like credit cards, cash cards, license cards and ID cards. An example can be found in Japanese disclosure Tokkaihei 9-131930 (U.S. Pat. No. 5,959,278) which teaches a direct transfer method printing apparatus that directly transfers images and characters to a recording medium via thermal transfer film. The use of a thermal sublimate ink has the benefit of attaining high quality images because this type of ink is more expressive. However, a receptive layer to receive ink on the surface of a recording medium to which images, etc., are transferred is an essential element to make this method of printing possible. Therefore, there is the problem that the types of recording medium that can be used is limited, or else it is necessary to form a receptive layer upon the surface of a recording medium.

Generally, cards made of polyvinyl chloride (also known as PVC cards) are widely used as a recording medium because they can receive thermal sublimate ink. However, due to the fact that harmful substances are generated when these cards are burned, consideration is being given to switching to cards made of polyethylene terephthalate (also known as PET cards). Furthermore, in recent years, there are card shaped media that have IC chips or antennae embedded therein. Such IC cards are used in a variety of fields. Because there is an object embedded in the card, the surface of the card ends up being uneven which results in image transfer problems.

Japanese patent number 2870574 teaches the technology of a thermal transfer method printing apparatus that overcomes the aforementioned problems in an indirect transfer method printing apparatus that transfers an image to an intermediate transfer medium once, then transfers that image again to the recording medium. According to this method, it is possible to overcome the problems of the direct transfer method, such as the limit to the type of recording medium, related to the receptive layer, or the problem of the transferring of images to an uneven surface of the recording medium, both of which are considered to be demerits of direct transfer printing. Furthermore, this method has the advantage of being easier to printing to the entire surface of the card shaped recording medium compared to the direct transfer method.

However, running costs associated with the intermediate transfer method are higher than those for the direct transfer method because an intermediate transfer medium must be used. Printing also takes longer. Furthermore, depending on the design of the card, even if the entire front surface is required for printing, often times the back side is used only to print precautions for card use. Therefore, there are fewer cases requiring printing to the entire surface, so there are merits and demerits for both methods of printing.

Therefore, if there were a printing apparatus that can switch between the printing methods of direct transfer method and the indirection transfer method to print images to a recording medium according to the characteristic of the recording medium, such as quality of the material of the recording medium, like PVC or PET, or whether or not it includes IC elements, and to the objective of use of the final print, it would be possible to print using the method best suited for each particular recording medium. This, in turn, would reduce the running costs that are associated with printing. It would also be possible to conceive that such a printing apparatus would become widely used in the future.

Currently, in the card market, there is a greater demand for esthetic reasons to be able to print to the entire surface of card-shaped recording medium. As a result, this type of printing is becoming more common.

However, in order to print to the entire surface of the card-shaped recording medium using the direct transfer method, print data, such as an image, must be generated or created in the same size as a normal card-shaped recording medium. Then that image data can be directly printed to that card-shaped recording medium. On the other hand, if using the indirect transfer method as described in the Japanese patent 2870574 mentioned above, it is difficult to position the image data region that is formed on the intermediate transfer film and the card-shaped recording medium because of the reducing that occurs in that intermediate transfer film. That makes is necessary, then, to generate or create image data to form on the intermediate transfer film that is larger than the card-shaped recording medium.

Specifically, to use a printing apparatus configuration that comprises both methods to print (or form images) to the entire surface of a card-shaped recording medium, it is necessary to have two different sizes of image data. More specifically, one size for each type of printing method would be required, even if the targeted image data is the same. This is very troublesome, and it results in higher costs in issuing cards.

OBJECT OF THE INVENTION

An object of the present invention is to provide highly applicable printing method, printing system and printing apparatus that are able to print beautiful images to the entire surface of media by switching between a direct transfer method and an indirect transfer method to improve convenience for printer users and to reduce the running costs associated with printing by using the image forming method that is best suited for the card medium.

SUMMARY OF THE INVENTION

In order to attain the aforementioned objectives, the first embodiment of the present invention comprises a first image printing mode that transports the first recording medium to the first image forming position and forms images entirely over one surface of the first recording medium at the image forming position. It also comprises a second image printing mode that transports an intermediate transfer medium that temporarily holds images to an image forming position. Then, after forming images on the intermediate transfer medium at the image forming position, this mode transports the intermediate transfer medium to an image transfer position while transporting a second recording medium or a first recording medium to the image forming position. There, it transfers the images formed on the intermediate transfer medium to one surface of the second recording medium or the entire other surface of the first recording medium at the image forming position. Thus, this invention can thus print images to at least one surface of the first recording medium or the second recording medium by forming images that have image data sized according to the first print mode or the second print mode.

According to this embodiment, in the first image printing mode the first recording medium is transported to the image forming position whereat images are formed to the entire surface of the first recording medium using the image size that corresponds to the first image printing mode. In the second image printing mode, an intermediate transfer medium that temporarily holds images is transported to the image forming position, whereat the image is formed thereupon the intermediate transfer medium in a size that differs from the size of the image data of the first image printing mode, according to the second printing mode which is based on the same image data as the first printing mode. Then, while transporting the intermediate transfer medium to the image forming position, the second recording medium or the first recording medium is also transported to the image forming position whereat images that were formed on the intermediate transfer medium are transferred to one surface of the second recording medium or to the entire other surface of the first recording medium. According to this embodiment, the image data size can be varied. Furthermore, images are printed to the entire surface of at least one side of either the first recording medium or the second recording medium so it is possible to print to the entire surface of the recording medium by switching between the direct transfer method and the indirect transfer method. Also, because there is no need for different sizes of the image data to correspond to the first image printing mode and to the second image printing mode, it is possible to provide a printing method that has a lower running cost yet high printing applicability.

It is also perfectly acceptable in this embodiment to vary the size of the image data according to intermediate transfer medium detection information and/or instruction information that specifies the image printing mode to be used. Included in this is instruction information that an operator can manually input using an operation panel or instruction information that is input from a computer. Also, it is acceptable to vary the image data size by setting the variable magnification ratio for the vertical and horizontal sizes of the image data to within the vertical and horizontal size ranges of either the first recording medium or the second recording medium to form images thereupon.

Also, in this embodiment, it is acceptable to print to the entire surface of at least one side of the first recording medium either with the same size as the image data or to reduce the size of the image data, when the first image printing mode is selected. Also, when reducing image data to form images, this invention calculates the average gradation value of a plurality of pixels in a predetermined vicinity of each pixel in the reduced image data. This makes it possible to set the calculated average gradation value to the gradation values for corresponding pixels. On the other hand, if the second image printing mode is selected, it is acceptable to use the same size as the image data, or to enlarge the size of the image data, to form the images on the intermediate transfer medium, then to transfer that image to the entire surface of at least one side of the second recording medium. When enlarging image data to form images, the system finds predetermined point of variation of the gradation value between adjacent pixels using the amount of variation in each pixel of enlarged image data. It increases or reduces the gradation values of each pixel at the point of variation and varies the amount of change in the gradation value in those adjacent pixels to calculate the average gradation value of a plurality of pixels in a predetermined vicinity. Then, it finds the difference of the calculated average gradation value and the gradation value of the corresponding pixels and either adds or subtracts that difference to/from the average gradation value of the corresponding pixels. If that gradation value is applied to the corresponding pixels, it then is possible to enhance the contours (or edges) to ensure high quality images on both the first recording media and the second recording media produced using the image data, even if that image data size is magnified.

Still further, to attain the aforementioned objectives, the second embodiment of the present invention is a printing system that comprises an image generating apparatus to generate images, and an image printing apparatus that prints the images generated by the image generating apparatus. The image printing apparatus comprises at least one printing means for selectively forming images to a recording medium via thermal transfer film that comprises an ink layer, and to an intermediate transfer medium that temporarily holds images, and transfer means for transferring images formed on the intermediate transfer medium to the recording medium with the same size, or a different size, as the recording medium. Further, provided are image conversion means for varying the magnification of the image data. The means forms images according to the second image printing mode that transfers images formed on the intermediate transfer medium using the transfer means. The transfer means transfers images to the entire surface of at least one side of the recording medium with the same size, or a different size, as the recording medium after images are formed with the first image printing mode that forms images to the entire surface of at least one side of the recording medium using the printing means, or forms images to the intermediate transfer medium using the printing means.

According to this embodiment, the printing system comprises an image generating apparatus that generates images, and an image printing apparatus that prints images generated by the image generating apparatus. The image printing apparatus comprises at least one printing means that selectively forms images to either a recording medium via thermal transfer film that comprises an ink layer, or to an intermediate transfer medium that temporarily holds the image. It also has transfer means for transferring images formed on the intermediate transfer medium to the recording medium using the same size, or a different size, as the recording medium. Furthermore, either the image generating apparatus or the image printing apparatus can comprise image variable magnification means for varying the magnification of the image according to either the first printing mode that forms images to the entire surface of at least one surface of the recording medium using the printing means, or to the second image printing mode that transfers images to the entire surface of at least one side of the same recording medium thereto formed with images from intermediate transfer film using the transfer means, after the printing means forms images onto the intermediate transfer film, or a different recording medium. According to this embodiment, the image variable magnification means varies the size of the image data according to the first image printing mode that forms images to the entire surface of at least one side of a recording medium using the printing means. It also varies the size of the image data according to the second image printing mode that transfers images of the same size or a different size than the recording medium, to the entire surface of at least one side of a recording medium using the transfer means after the images are formed on the intermediate transfer medium. With the first image printing mode, images are formed on the recording medium via a transfer film comprising an ink layer using at least one printing means. With the second image printing mode, images are formed on the intermediate transfer medium via a transfer film by at least one printing means, and with the transfer means, images formed on the intermediate transfer medium are transferred to the recording medium with the same size, or a different size, as the recording medium. According to this embodiment, an image whose image data size is varied by the image variable magnification means is printed to the entire surface of at least one side of the recording medium with the same size as the recording medium or a different size, according to the first and the second image printing mode. Therefore, it is possible to print to the entire surface of recording medium by switching between the direct transfer method and the indirect transfer method and because different image data for the first image printing mode and the second image printing mode is unnecessary, lower running costs are attainable, while providing a printing system with a high range of applicability.

With this embodiment, to prevent the degradation of an image which is caused by its being reduced in size, the image variable magnification means calculates the average gradation value of a plurality of pixels in a predetermined vicinity of the pixels of the reduced size image data, when the image data size is reduced for forming. Then, that calculated average gradation value is set to the gradation values of the corresponding pixel. For pixels in image data that is enlarged in size, the image variable magnification means finds the predetermined point of variation from the amount of variation of the gradation value between adjacent pixels, and it either increases or reduces that gradation value for the pixel corresponding to that point of variation, thereby differing the amount of variation of the gradation value for the adjacent pixels. Further comprised are the image printing mode selection means for selecting either one of the first image printing mode or the second image printing mode. Image printing mode selection means determine and select either of the first image printing mode or the second image printing mode according to the detection information of the intermediate transfer medium, and/or instruction information from a manually set image printing mode setting signal and/or from the image generating apparatus. Still further, when the second image printing mode is selected by the image printing mode selection means, the image variable magnification means performs variably magnification to variably set the expansion ratio of the image data in the vertical and horizontal sizes within the range of the vertical and horizontal size ratios of the recording medium.

Still further, to attain the objectives, a third embodiment comprises a first image printing process that transports the first recording medium to an image forming position and forms images to the entire surface of the first recording medium at the image forming position. Also comprised is the second image printing process that transports the intermediate transfer medium that temporarily holds images to the image forming position whereat an image is formed on the intermediate transfer medium. Then, while transporting the intermediate transfer medium to the image transfer position, it transports a second recording medium or the first recording medium to the image transfer position to transfer the image form on the intermediate transfer medium to one side of the second recording medium or to transfer that image to the entire surface of the other side of the first recording medium at the image transfer position. In the first image printing process and the second image printing process images are printed to the entire surface of at least one side of either the first recording medium or the second recording medium, based on the same image data.

In this embodiment, the first recording medium is transported to the image forming position in the first image printing process, whereat an image is formed to the entire surface of one side of the first recording medium according to the image data. In the second image printing process, the intermediate transfer medium that temporarily holds images is transported to the image forming position where images are formed thereupon according to the same image data. Then while transporting the intermediate transfer medium to the image transfer position, a second recording medium or the first recording medium is transported to the image transfer position whereat the image formed upon the intermediate transfer medium is transferred to the entire surface of at least one side of either the first recording medium or the second recording medium (one side of the second recording medium or the other side of the first recording medium). According to this embodiment, images are printed to the entire surface of at least one side of either the first recording medium or the second recording medium based on the same image data. While it is possible to print to the entire surface of the recording medium by switching between the direct transfer method and the indirect transfer method and because there is no need to prepare image data having a different size for the first image printing process and the second image printing process, it is possible to provide a printing method that has a low running cost and high printing applicability.

If the image to be printed using the first image printing process or the second image printing process is equivalent to the image data, it is possible to print an image without any of the degradation that comes with variable magnification (enlarging or reducing). Also, according to this embodiment, the image data read-out position for forming the image on the first recording medium or the intermediate transfer medium is decided according to the first image printing process or the second image printing process when the vertical direction and horizontal direction sizes of the image data are acquired and the system determines printing will use either the first image printing process or the second image printing process, and the image data read-out position for forming the image on the first recording medium or the intermediate transfer medium is decided. This makes it possible to form images on the appropriate position on the first recording medium and the intermediate transfer medium. At this time, it is possible to determine the image data read out position by setting a reference position in a line using a single pixel as units for both the vertical direction and the horizontal direction of the image data. Also, it is possible to determine either of the first image printing process or the second image printing process according to the detection information of the intermediate transfer medium, and/or the instruction information that specifies either the first or the second image printing process.

Still further, through this embodiment, the system calculates the vertical direction size of the image data and the vertical direction difference with the maximum predetermined size that the image can be formed in a first direction on the intermediate transfer medium that corresponds to the vertical direction, when the second image printing process is selected. Then, it is possible to establish the pixel position which is calculated with ½ the vertical direction difference at the pixel position where the writing of the vertical direction in the memory ended as a first read out reference position of the image data to form the image onto the intermediate transfer medium. Also, the system calculates the horizontal direction difference between the size of the image data in the horizontal direction and the maximum predetermined size that the image can be formed in a second direction on the intermediate transfer medium that corresponds to the horizontal direction. Then, it is possible to establish the pixel position which is calculated with ½ the horizontal direction difference where the writing of the horizontal direction in the memory ended as a second read out reference position to form the image onto the intermediate transfer medium. In this case, the intersecting point of the first read out reference position and the second read out reference position can be set as the image data read out starting position to form an image on the intermediate transfer medium. The image data that is read out from the image data read out starting position is read out in the direction reverse to the direction that the image data was written to the memory. An image is formed onto the intermediate transfer medium as a mirror image of that image data.

Still further in this embodiment, the system calculates the vertical direction difference between the vertical direction size of the image data and size in a first direction on the first recording medium that corresponds to the vertical direction, when the first image printing process is selected. Then, it is possible to establish the pixel position which is calculated with ½ the vertical direction difference from the pixel position where writing of the vertical direction to the memory ended as a first read out reference position of the image data to form the image onto the first recording medium. Also, the system calculates the horizontal direction difference between the horizontal direction image data size and the size in a second direction on the first recording medium that corresponds to the horizontal direction. Then, it is possible to establish the pixel position which is calculated with ½ the horizontal direction difference from the pixel position where writing of the horizontal direction to the memory started as a second image data read out reference position to form the image onto the first recording medium. In this case, the intersecting point of the first read out reference position and the second read out reference position can be set as the image data read out starting position to form the image on the first recording medium. The image data that is read out from the image data read out starting position is read out in the same direction as image data was written to the memory. The image is formed onto the first recording medium as a positive image of that image data.

Still further to attain the aforementioned objectives, the fourth embodiment of the present invention comprises at least one printing means for selectively forming images on a recording medium via a thermal transfer film that comprises an ink layer or to an intermediate transfer medium that temporarily stores images, transfer means for transferring images formed on the intermediate transfer medium to the recording medium with the same size or a different size than the recording medium, and image data storage means for storing image data. Also comprised in this embodiment are the print data region setting means that acquires the vertical direction and horizontal direction sizes of the image data stored in the image data storage means, calculates the difference of the acquired size and the predetermined size of the recording medium, or the maximum predetermined size that the image can be formed on the intermediate transfer medium, adds or subtracts ½ of the difference calculated for the starting position or the ending position to write the image data written in the image data storage means to set the print data read out starting position to form images. Also comprised are image forming mode selection means for selecting either the first image forming mode that forms images to the entire surface of at least one side of the recording medium using the printing means or the second image forming means that forms images on the intermediate transfer medium using the printing means. The print data read out starting position set by the print data region setting means varies according to the first or the second image forming modes selected by the image forming mode selection means. With this embodiment, the print data region setting means sets the reference position to determine the starting position to read out print data in both the vertical and horizontal directions of the image data read out from the image data storage means. It is possible to also comprise energizing control means for energizing the printing means using the pixel position located at the intersecting point on the reference position as a reference position as the starting position to read out the print data set for the vertical direction and horizontal direction of the image data.

These and other objects, aspects and embodiments of the present invention will now be described in more detail with reference to the following drawing figures.

DETAILED DESCRIPTION OF THE DRAWINGS

FIG. 4A is a front view showing a model of the thermal transfer film, FIG. 4B is a sectional view showing a model of the intermediate transfer film.

FIG. 10A is the card before printing, FIG. 10B is the card after printing.

FIG. 11A shows when the image data is enlarged the same dimension vertically and horizontally, FIG. 11B shows the image data enlarged according to the vertical and horizontal dimensions of the card.

Figure 13A:
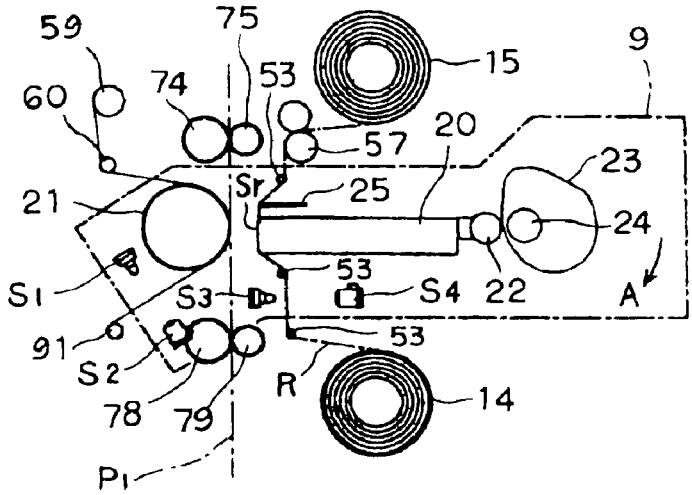
Figure 13B:
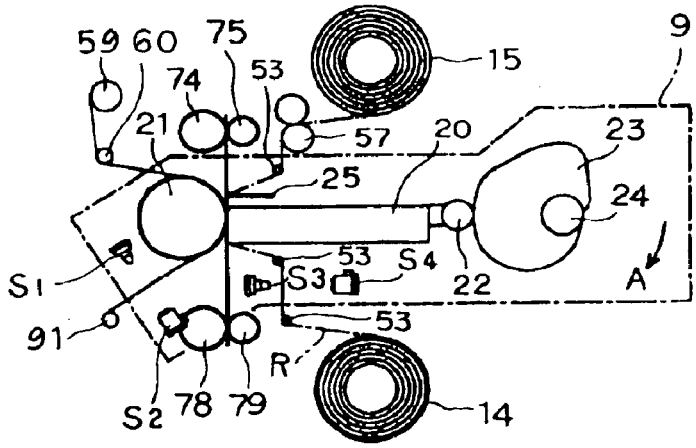
Figure 13C:
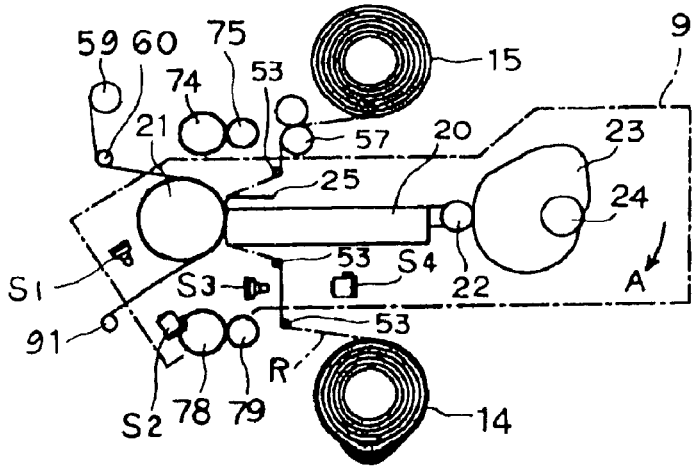

FIG. 13A, FIG. 13B and FIG. 13C are front views of the image forming portion of the printing apparatus according; FIG. 13A shows the thermal head retracted; FIG. 13B shows forming an image on a card by the direct transfer; FIG. 13C shows forming and image on the intermediate transfer film.

Figure 14A:
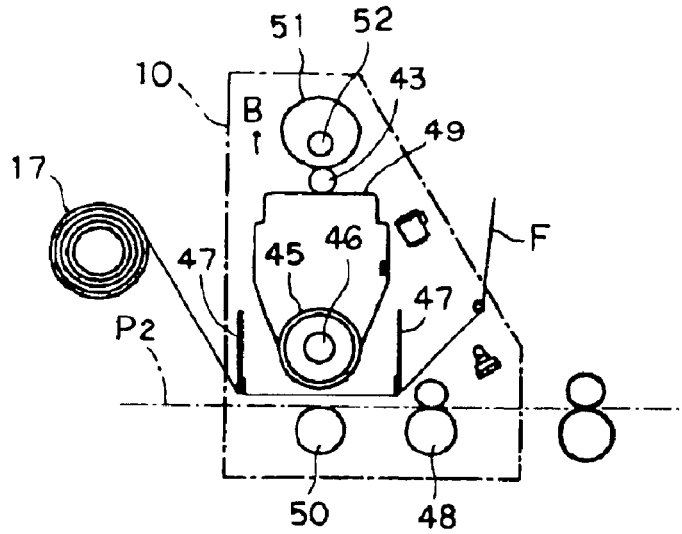
Figure 14B:
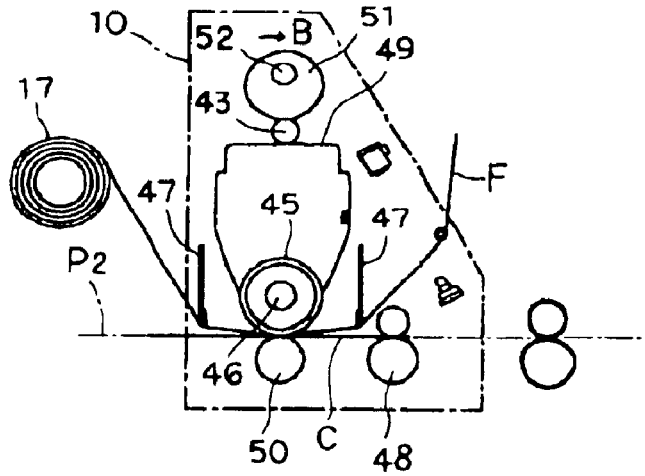

FIG. 14A and FIG. 14B are front views of the transfer portion on the printing apparatus; FIG. 14A shows the heat roller retracted; FIG. 14B shows transferring an image onto a card using intermediate transfer.

Figure 15A:
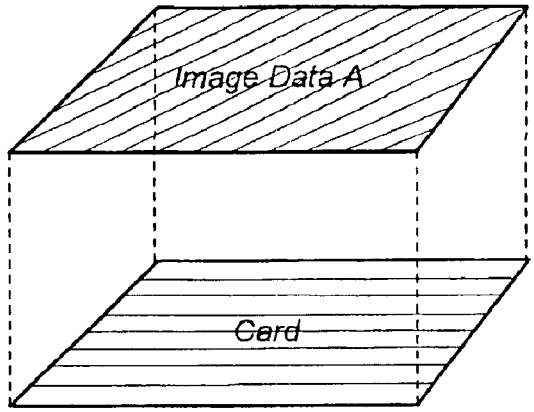
Figure 15B:
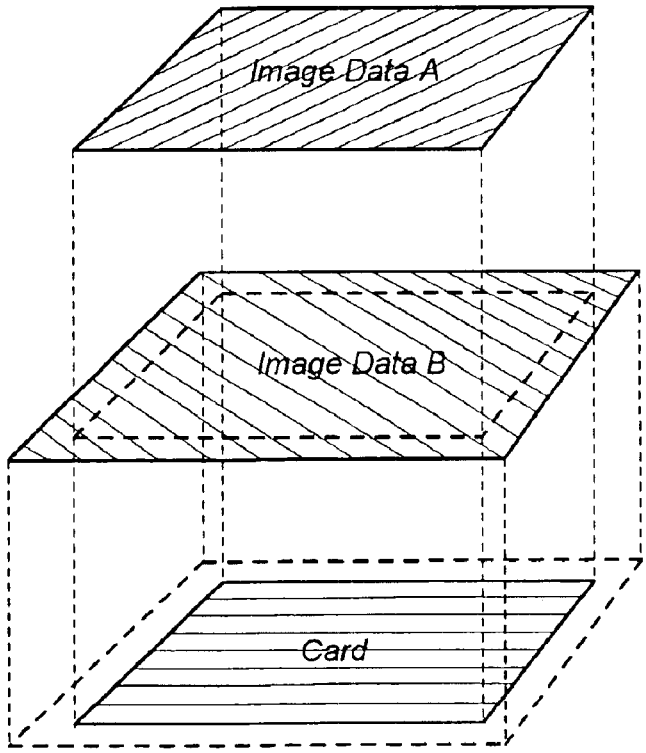

FIG. 15A and FIG. 15B are drawings showing the relationship of image data and the card when printing to the entire surface, FIG. 15A shows the direct transfer method, FIG. 15B shows the indirect transfer method.

Figure 16A:
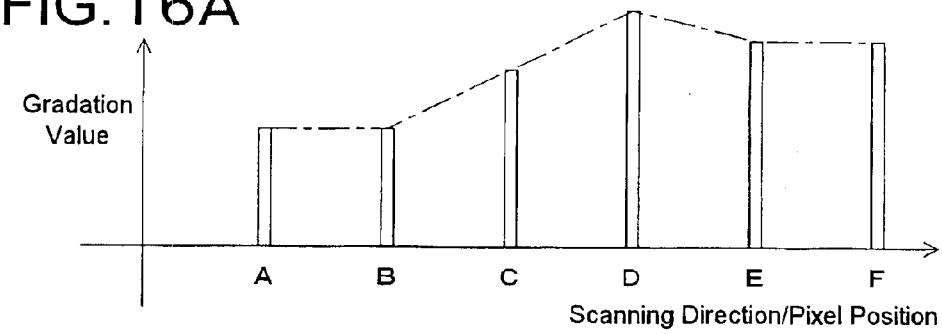
Figure 16B:
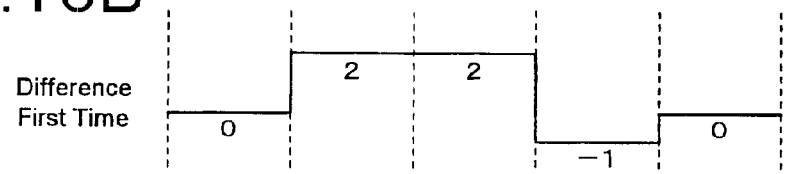
Figure 16C:
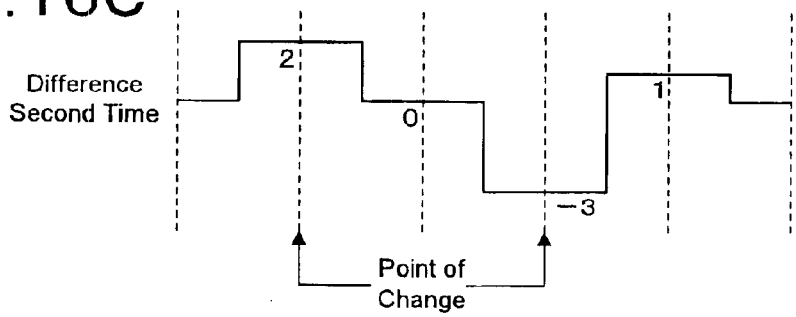
Figure 16D:
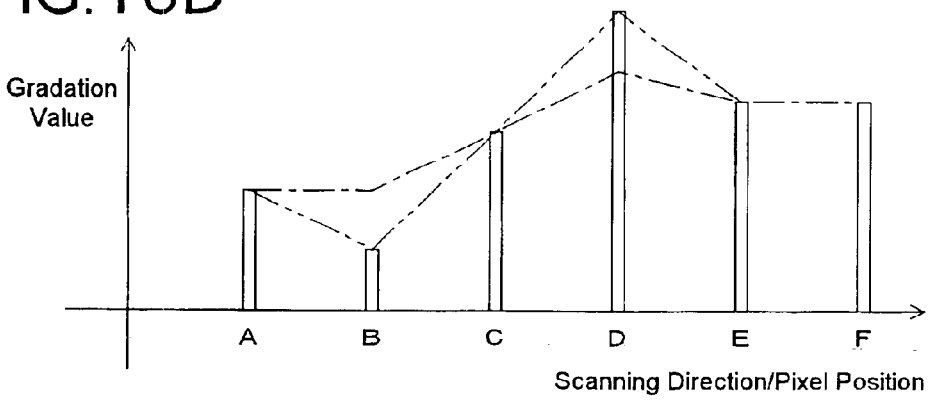

FIG. 16A, FIG. 16B, FIG. 16C, and FIG. 16D are drawings showing the contour enhancing process, FIG. 16A shows a model of the relationship of the pixel position and gradation value in the scanning direction before contour enhancing, FIG. 16B is a graph showing the concept for the first time difference of the gradation value, FIG. 16C, is a graph showing the concept for the second time difference of the gradation value, FIG. 16D shows the relationship of the gradation value before contour enhancing and the gradation value after contour enhancing.

Figure 17:
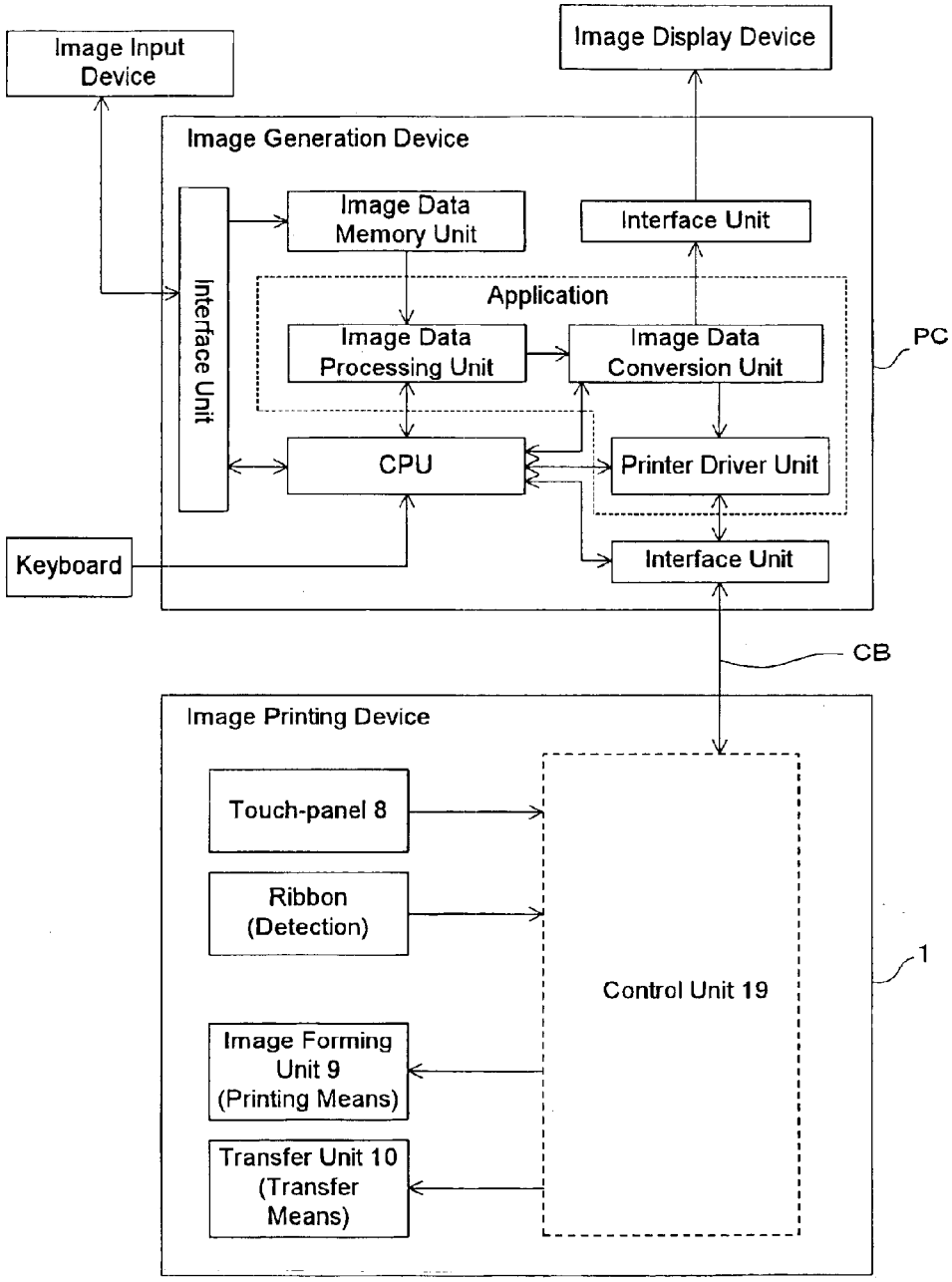

FIG. 17 is a block diagram representing the functions of the personal computer in the printing system.

Figure 18:
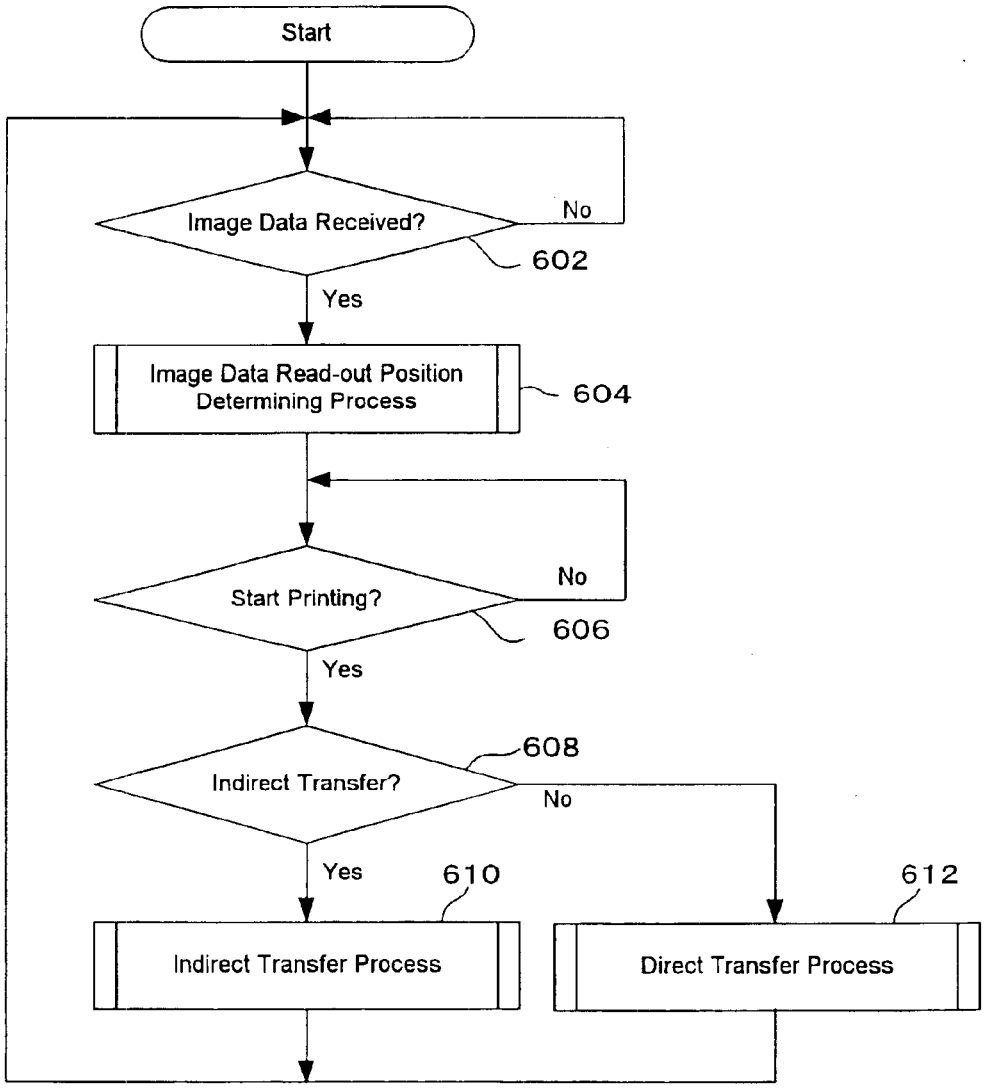

FIG. 18 is an image forming routine flowchart executed by the printing apparatus control unit CPU.

Figure 19:
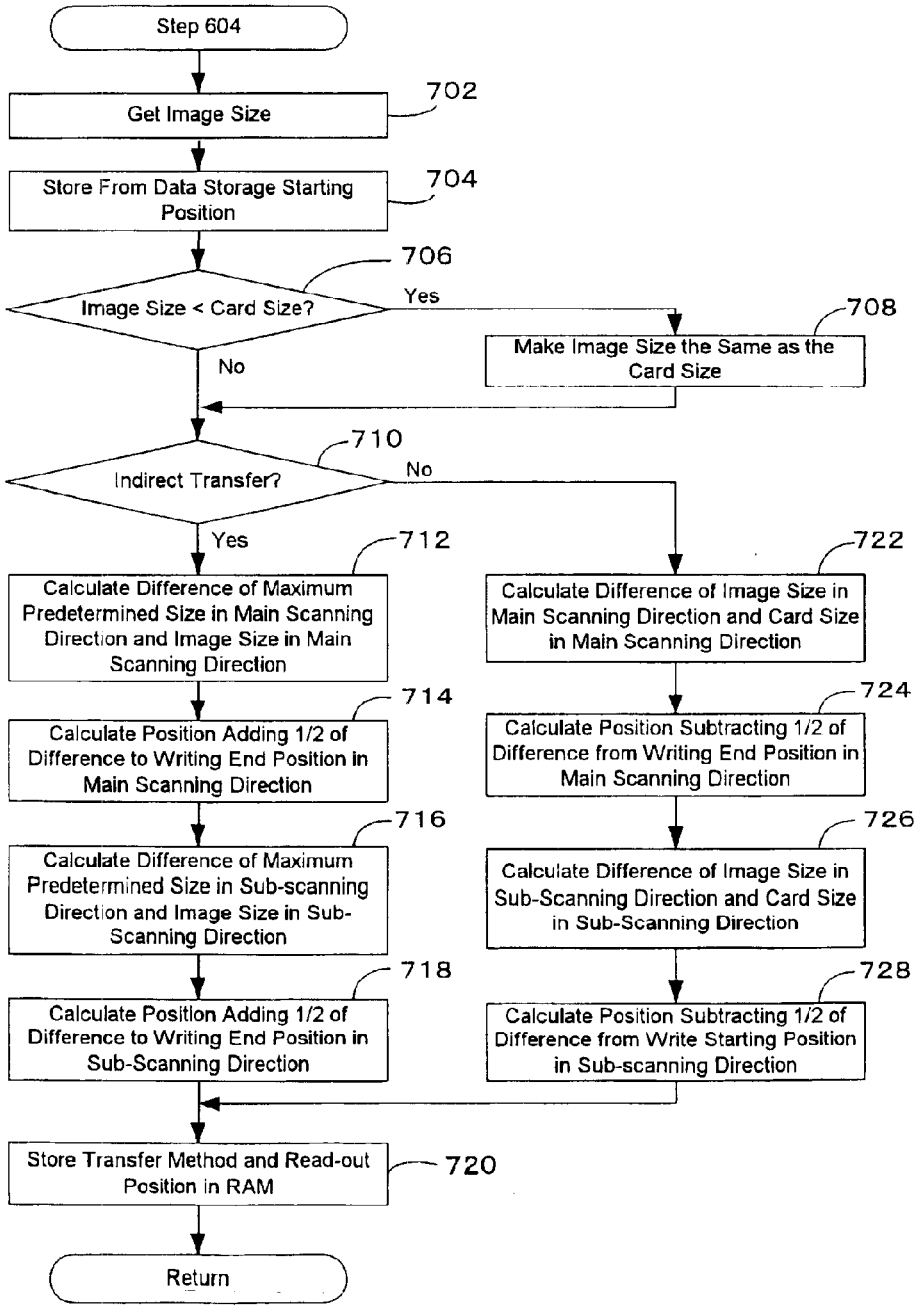

FIG. 19 is a flowchart of a subroutine of the image data read out position determined process showing the details of step 604 of the image forming routine.

Figure 20:
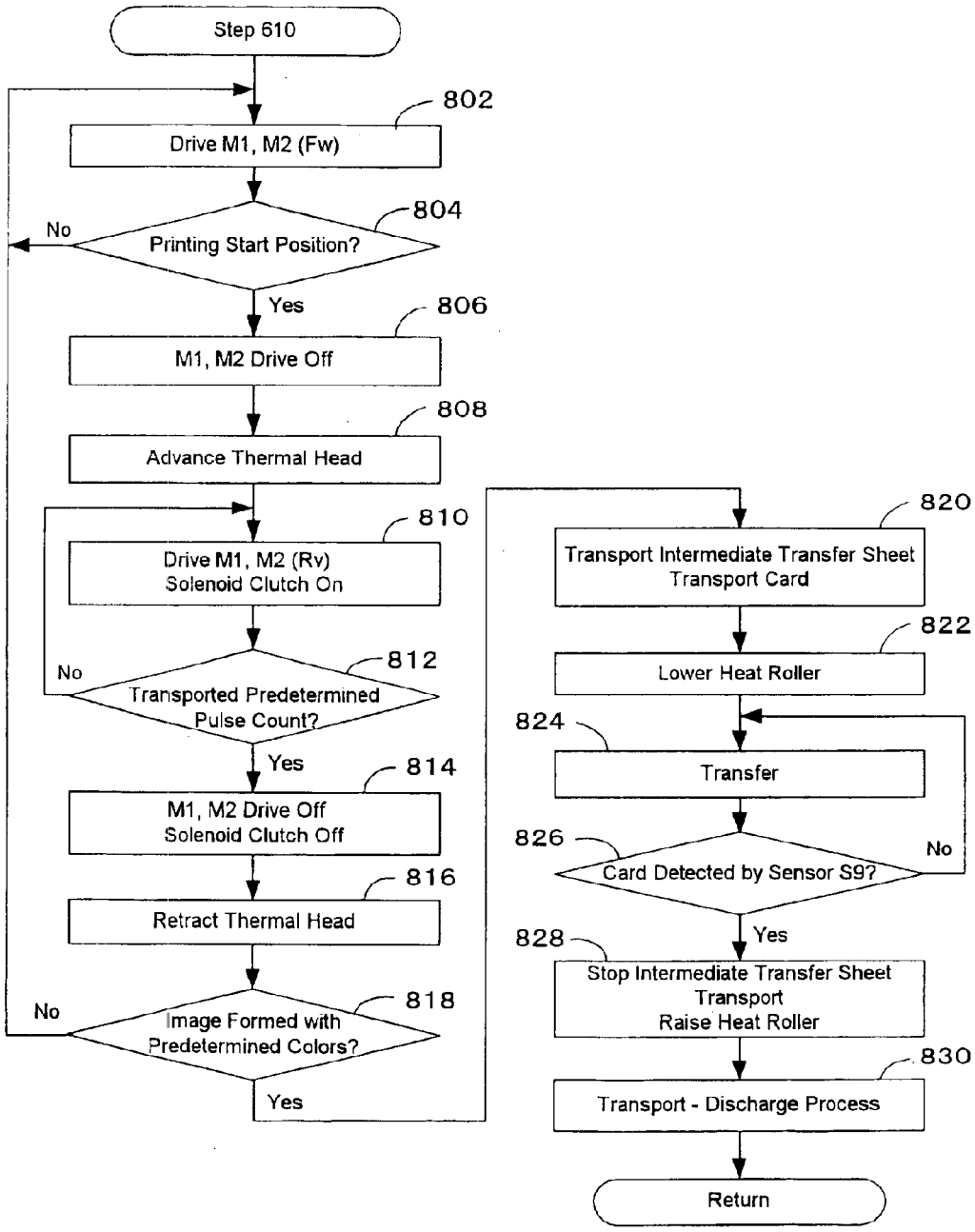

FIG. 20 is a flowchart of a subroutine of the indirect transfer process showing the details of step 610 of the image forming routine.

Figure 21:
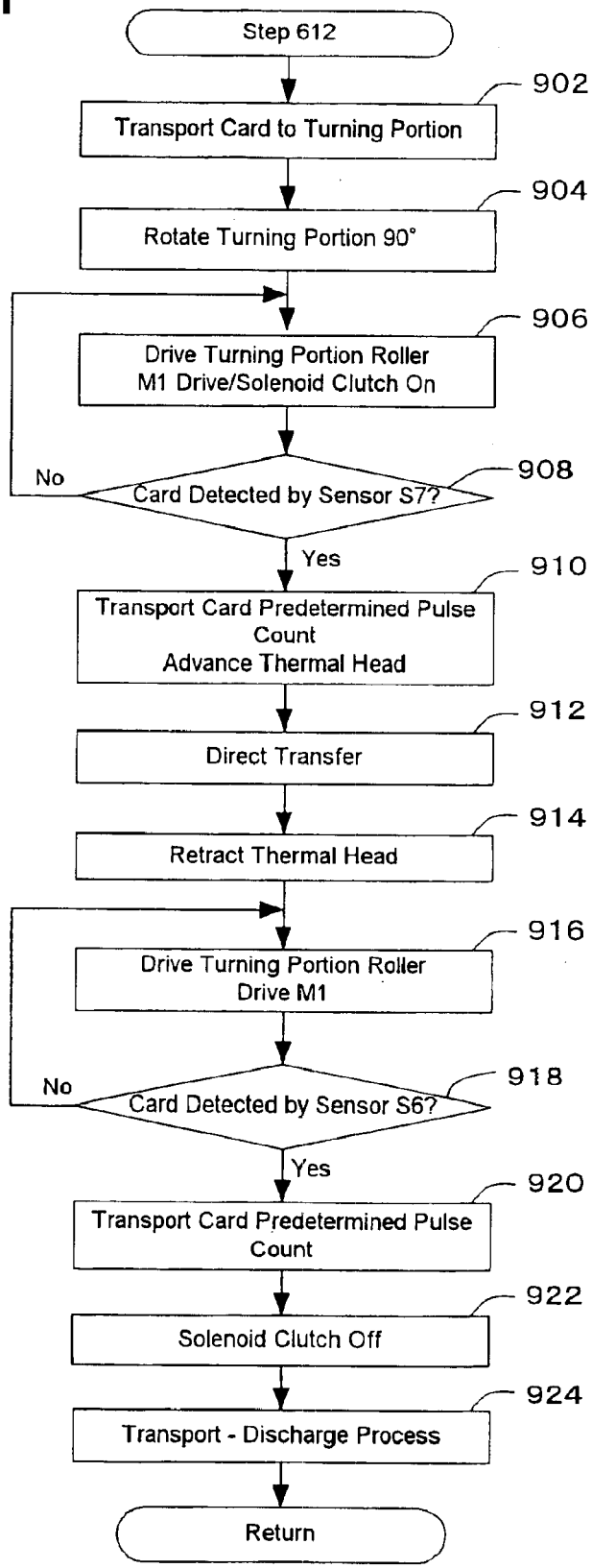

FIG. 21 is a flowchart of a subroutine of the direct transfer process showing the details of step 612 of the image forming routine.

Figure 22:
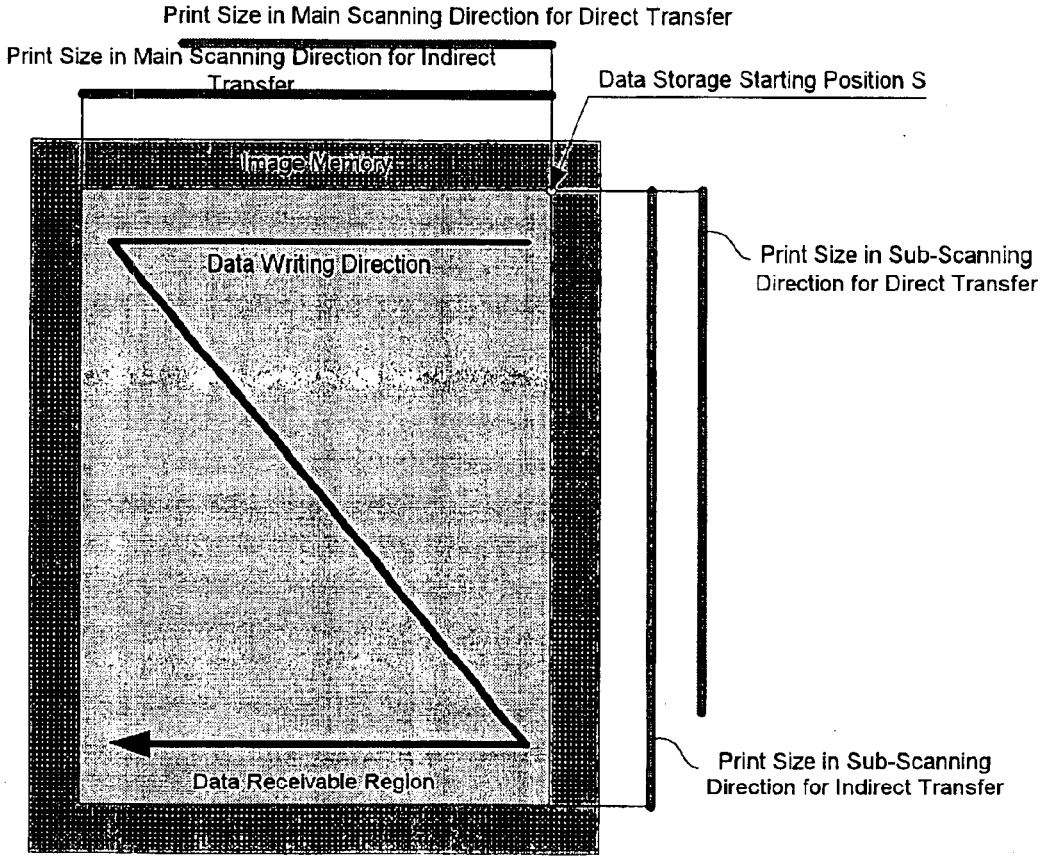

FIG. 22 is a drawing showing the image data stored in SDRAM.

Figure 23A:
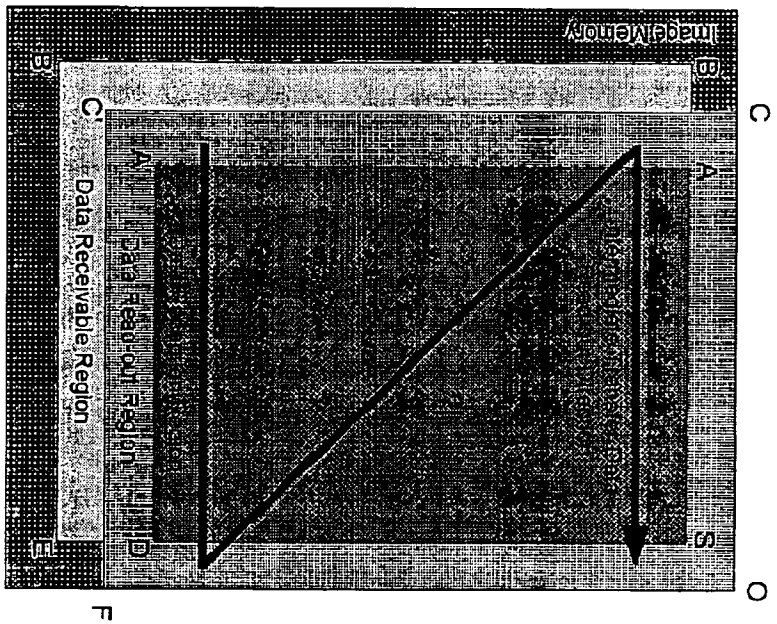
Figure 23B:
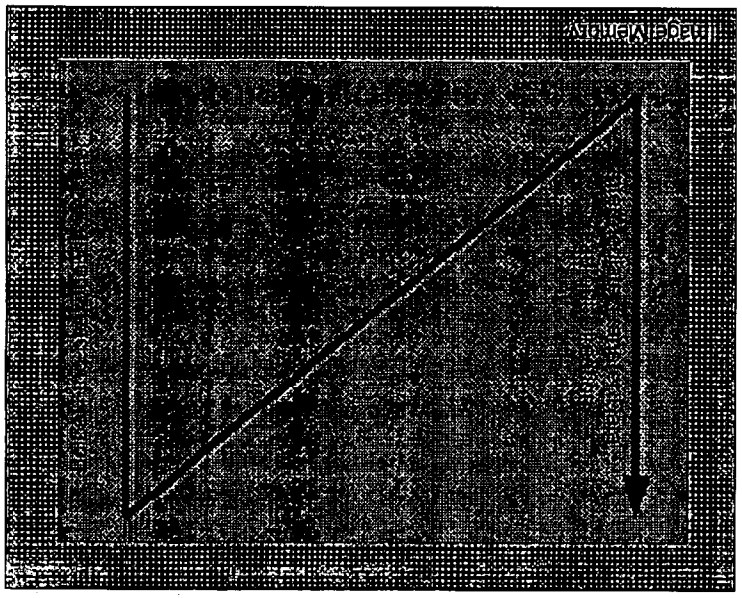

FIG. 23A and FIG. 23B are drawings showing the image data read out from SDRAM when the indirect transfer method is selected, FIG. 23A shows image data smaller than the card size stored in SDRAM, FIG. 23B shows the maximum size of image data stored in SDRAM.

Figure 24A:
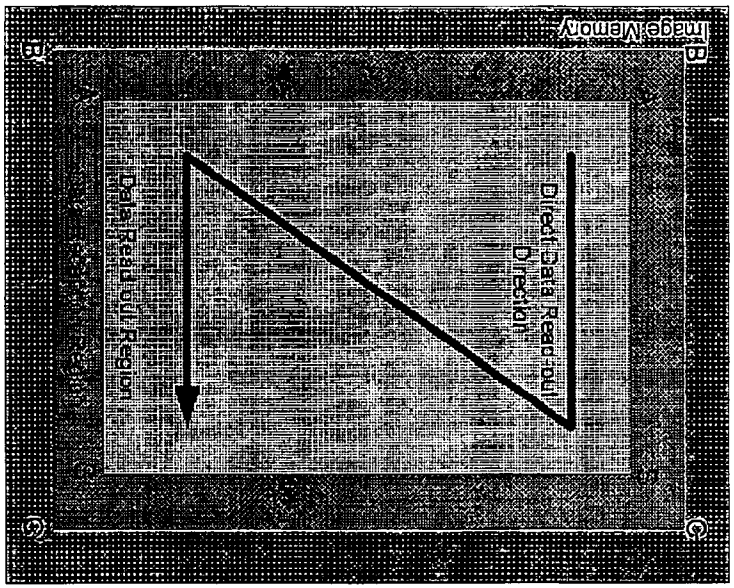
Figure 24B:
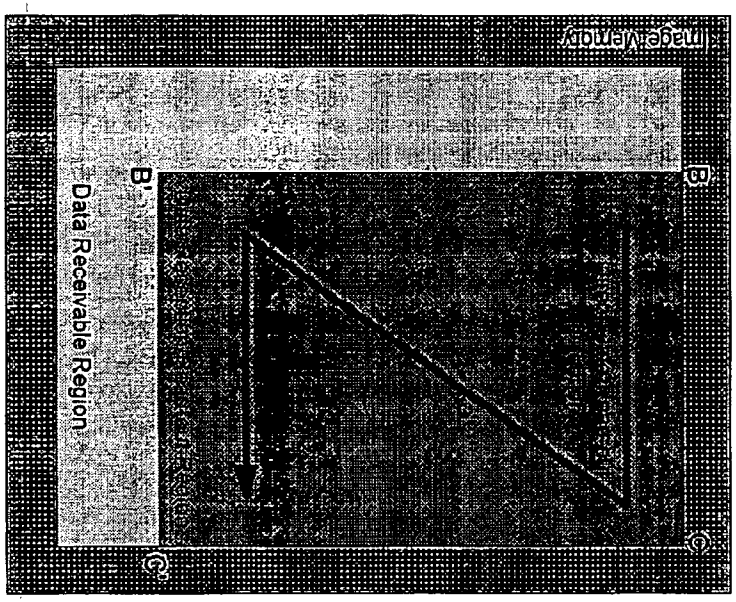

FIG. 24A and FIG. 24B are drawings showing the image data read out from SDRAM when the direct transfer method is selected, FIG. 24A shows the maximum size image data stored in SDRAM, FIG. 24B shows image data smaller than the card size stored in SDRAM.

DETAILED DESCRIPTION OF THE PREFERRED EMBODIMENTS

The following is a detailed description of the first embodiment of the printing system that applies the invention in reference to the drawings.

Figure 1:
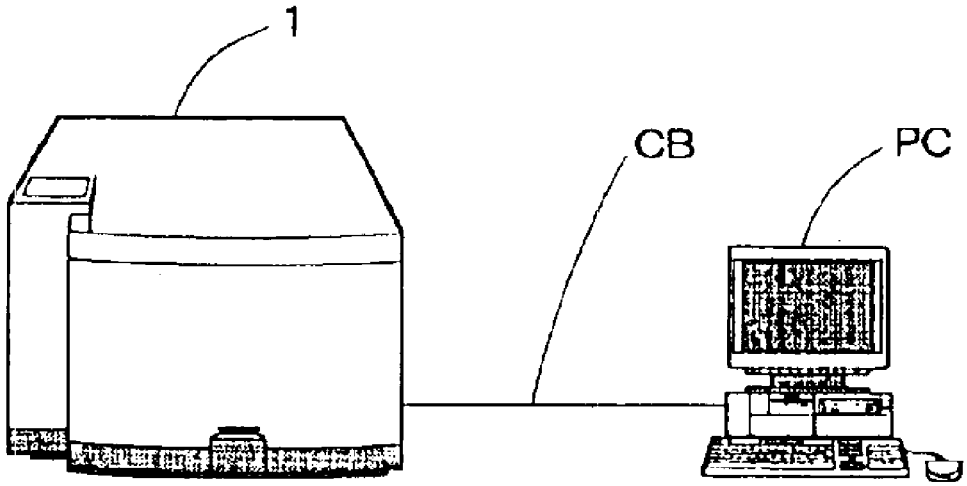
FIG. 1 is a perspective view external appearance of the printing system in an embodiment to which this invention can be applied.

As shown in FIG. 1, a printing apparatus 1 used as the image printing apparatus that prints images to a recording medium such as cards and a personal computer (hereinafter referred to as PC) used as the image generating apparatus that sends generated or created images to the printing apparatus 1, are linked in the printing system according to the present invention via a connecting cable CB such as a SCSI type connector.

Figure 2:
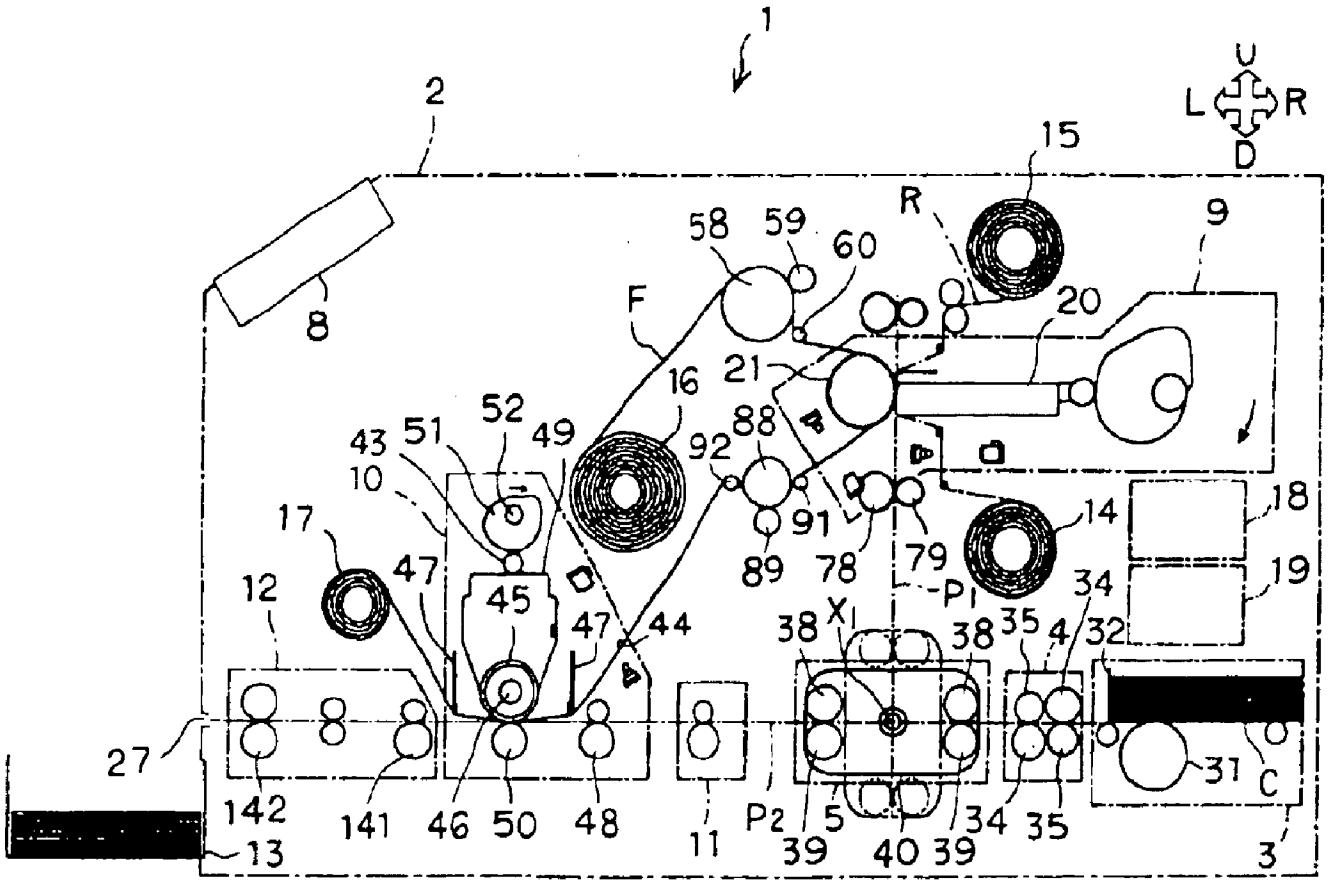
FIG. 2 is a front view showing the general configuration of the printing apparatus in the printing system.

Clearly shown in FIG. 2, the printing apparatus 1 comprises in the housing of the frame 2, the first card transport path P1 comprising a card transport path for forming printing) images to the card C, as the recording medium, using the direct transfer method, and the second card transport path P2 comprising of a card transport path for transferring to the card C images temporarily held on the intermediate transfer film F, as the intermediate transfer medium, using the indirect transfer method. The second card transport path P2 is arranged substantially horizontally, and the first card transport path P1 is arranged substantially vertically. The first card transport path P1 and the second card transport path P2 intersect orthogonally at intersecting point X1.

On the second card transport path P2 are arranged the card supply portion 3 that separates and feeds the card C one at a time to the second card transport path P2, the cleaner 4 that cleans both surfaces of the card C downstream of the card supply portion 3, and the turning portion 5 that rotates or inverts while nipping the card C to turn its transport path to be orthogonally arranged to the first card transport path P1 direction using the intersection point X1 downstream of the cleaner 4 as the center of rotation.

The card supply portion 3 comprises the card stacker that stores a stack of a plurality of the card C. The stacker side plate 32 that comprises an opening slot to allow only one of the cards C to pass therethrough is arranged to face the second card transport path P2 on the card stacker. To the bottom of the card stacker is pressingly arranged the kick roller 31 that rotatingly feeds the bottommost blank card C of the plurality of blank cards C that are stackingly stored in the card stacker, to the second card transport path P2.

The cleaner 4 comprises the cleaning roller 34 which is made of a rubber material, the surface thereof applied with an adhesive substance, and the pressing roller 35 that presses against the cleaning roller 34. The cleaning roller 34 and the pressing roller 35 opposingly face each other to sandwich the second card transport path P2.

The turning portion 5 comprises the pinch rollers 38 and 39 that are paired to nip the card C and comprises the turning frame 40 that turns or rotates around the intersecting point of X1, rotatingly supporting these pinch rollers. One of the pinch rollers 38 and 39 is a forward and reversingly rotatable drive roller, and the other is a follower roller. The pinch rollers 38 and 39 are in pressing contact to sandwiching the second transport path P2 when the turning frame 40 is horizontally positioned (the state indicated by the solid lines in FIG. 2) and are in pressing contact to sandwich the first card transport path P1 when the turning frame 40 is vertically positioned (the state indicated by the dotted lines in FIG. 2). When the turning frame 40 is rotated or turned while nipping a card between the pinch rollers 38 and 39, the pinch rollers 38 and 39 would also rotate thereby displacing the card C, so the rotating or turning action at the turning portion 5 is driven independently to the rotation or inversion of the turning frame 40 and to the rotation of the pinch rollers 38 and 39.

Note that near the turning portion 5 is arranged the unitized transmissive sensor (combined with the slit plate), not shown in the drawings, to detect the angle of rotation of the turning frame 40. Also, to determine the direction of rotation of the pinch rollers 38 and 39, a unitized transmissive sensor (combined with a semi-circular plate), also not shown in the drawings, is arranged to detect the position of either of one of the pinch rollers 38 and 39. While the angle of rotation of the rotating frame 40 can be freely set, the direction of the transport of the card C by the pinch rollers 38 and 39 is controlled.

Additionally, in the printing apparatus 1, downstream of the turning portion 5 (the direction of the arrow U in FIG. 2) on the first card transport path P1, is arranged the image forming portion 9 which is used as the printing means for forming images onto the card C using a thermal transfer ink or to the intermediate transfer film F according to image data (positive image data and mirror image data) sent from the image forming control unit 19C (see FIG. 5), which is described later. A thermal transfer printer configuration is employed in the image forming portion 9 which comprises the platen roller 21 that supports the card C when printing to a surface thereof and the thermal head 20 retractably arranged to the platen roller 21. The thermal transfer film R is interposed between the platen roller 21 and the thermal head 20.

As is shown in FIG. 13A, FIG. 13B and FIG. 13C, the advancing and retracting movement of the thermal head 20 to and from the platen roller 21 is performed by the thermal head sliding drive unit that comprises the holder, not shown in the drawings, that removably holds the thermal head 20, the follower roller 22 which is fastened to the holder, the non-circular thermal head sliding cam 23 that rotates in either direction (the direction of arrow A or the opposite in the drawing) around the cam shaft 24 while touching the outer surface of the follower roller 22 and the spring, not shown in the drawings, that presses the holder against the thermal head sliding cam 23.

Figure 4A:
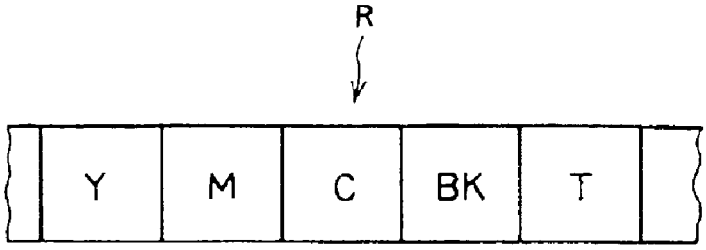
FIG. 4A and FIG. 4B are drawings of the thermal transfer film and intermediate transfer film.

As shown in FIG. 4, the thermal transfer film R comprises the inks of Y (yellow), M (magenta), C (cyan) and Bk (black) in that order on the film having widths slightly larger than the length of the card C in the length direction, and comprises a protective layer region T that protects the card C surface formed thereupon by images, after the Bk (black), in repeated bands in order along the surface.

FIG. 13B and FIG. 13C show the thermal transfer film R supplied from the thermal transfer film supply portion 14 where the thermal transfer film R is wound in a roll, guided by a plurality of guide rollers 53 and the guide plate 25 which is mounted to the holder, not shown in the drawings. While touching substantially the entire surface of the leading edge of the thermal head 20, the thermal transfer film R is driven along by the rotational drive of the paired take-up rollers 57 and rolled onto the thermal transfer film take-up portion 15. The thermal transfer film supply portion 14 and the thermal transfer film take-up portion 15 are arranged in positions on both sides of the thermal head 20, the centers thereof mounted onto the spool shaft. To the image forming portion 9, the light emitting element S3 and light receiving element S4 (hereinafter called the light reception sensor S4) for detecting the mark for positioning of the thermal transfer film R or the position of the Bk portion on the thermal transfer film R, are separately arranged at a right angles to the thermal transfer film R between the guide rollers 53 arranged between the thermal transfer sheet supply portion 14 and the thermal head 20.

Note that to the drive side roller shaft of the paired take-up rollers 57 is mated a gear, which is not shown in the drawings. The gear meshes with the gear that comprises the clock plate not shown in the drawings on the same shaft. Near the clock plate (not shown) is arranged the unitized transmissive sensor, which also is not shown, that detects the rotation of the clock plate to control the amount of take-up of the thermal transfer film R.

As can be seen in FIG. 13A, the printing position (heating position) Sr of the thermal head 20 interposed by thermal transfer film R toward the card C (or as described below, the intermediate transfer film F) is an outer circumference portion of the platen roller 21. This corresponds to the portion that touches the first card transport path P1. In FIG. 13B, on both sides of the image forming portion 9 are arranged the paired upper rollers composed of the capstan roller 74 that has a constant rotating speed, the pinch roller 75 pressing thereto and the lower paired rollers configured by the capstan roller 78 and the pinch roller 79 that sandwich the first card transport path P1 and rotate in synchronization to the moving of the card C in the up and down directions with regard to the printing position Sr.

Figure 4B:
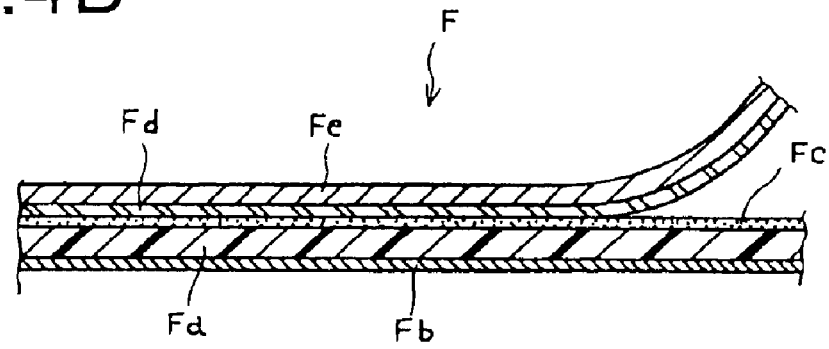

As shown in FIG. 2 and FIG. 13A to FIG. 13B, the intermediate transfer film F is trained around the platen roller 21 on the surface facing the thermal head 20. As shown in FIG. 4B, the intermediate transfer sheet F is formed the layers of the base film Fa, the back surface coating layer Fb formed on the back side of the base film Fa, the receptive layer Fe that receives ink, the overcoat layer Fd that protects the receptive layer Fe surface, the peeling surface Fc formed on the base film Fa and that aids in the heat peeling of the overcoat layer Fd and the receptive layer Fe from the base film Fa. The back surface coating layer Fb, the base film Fa, the peeling surface Fc, the overcoat layer Fd, and the receptive layer Fe are formed in layers in that order from the bottom. The intermediate transfer film F is trained with the receptive layer Fe opposing the thermal transfer film R and the back surface coating layer Fb side touching the platen roller 21. At the printing position Sr, the transport speed of the intermediate transfer film F when printing to the card C using the direct transfer method (see FIG. 13B) and when forming images on the intermediate transfer film (see FIG. 13C), is set to the same speed as that for the transport speed of the thermal transfer film R. Furthermore, when printing to the card C using the direct transfer method, the transport speeds of the intermediate transfer film F and the card C are set to be the same. Note that to the image forming portion 9, the light emitting element S1 and the light receiving element S2 (called light reception sensor S2 below) that detects the mark for positioning of the intermediate transfer film F are separately arranged at right angles to the intermediate transfer film F between the platen roller 21 and guide roller 91. This arrangement can be seen in FIG. 13A, FIG. 13B and FIG. 13C.

Additionally, as shown in FIG. 2, on the second card transport path P2, downstream of the turning portion 5 on the image forming apparatus 1 are disposed the paired horizontal transport rollers 11 that transport the card C in the horizontal direction, the transfer portion 10, as the transfer means that transfers images formed on the intermediate transfer film F at the image forming portion 9 to the card C, and the horizontal transport portion 12 comprising the paired discharge rollers 142 that discharge the card C outside of the frame 2 and a plurality of paired transport rollers that transport the card C in the horizontal direction.

The transfer portion 10 comprises the platen roller 50 that supports the card C when transferring from the intermediate transfer film F to the card C and the heat roller 45 slidably arranged to the platen roller 50. Embedded in the heat roller 45 is the heating lamp 46 as the heating body that heats the intermediate transfer film F. The intermediate transfer film F is interposed between the platen roller 50 and heat roller 45.

As is shown in FIG. 14A and FIG. 14B, the advancing and retracting movement of the heat roller 45 toward the platen roller 50 is executed by the elevator drive unit that comprises the holder 49 that removably holds the heat roller 45, the follower roller 43 that is fastened to the holder 49, the non-circular heat roller elevator cam 51 that rotates in one direction (the direction of arrow B in the drawing) around the cam shaft 52 while following the outer contour of the follower roller 43 and the spring, not shown in the drawings, that presses the upper surface of the holder 49 against the heat roller elevator cam 51.

The intermediate transfer film F is supplied from the intermediate transfer film supply portion 16, the intermediate transfer film F rolled thereabout, and is guided by the transport roller 58 that is accompanied by the follower roller 59, the guide roller 60 and platen roller 21, the guide roller 91, the back tension roller 88 that applies a reverse tension to the intermediate transfer sheet F along with the pinch roller 89, the guide rollers 92 and 44 and the guide plate 47 mounted to the frame configuring the transfer portion 10 arranged on both sides of the heat roller 45. When transferring, the card C is sandwiched between the platen roller 50 and heat roller 45 on the second card transport path P2 and the intermediate transfer film F is taken up by the intermediate transfer film take-up portion 17 that takes up the intermediate transfer film F.

In addition, to the transfer portion 10, downstream of the paired horizontal transport rollers 11 and upstream of the platen roller 50, are arranged the paired transport rollers 48 that are pressed together to sandwich the second card transport path P2 to transport the card C in the direction of the arrow L along with the paired capstan rollers 141 arranged at the transfer portion 10 on the horizontal transport path 12. They are the drive rollers for the capstan roller. The paired horizontal transport rollers 11, paired transport rollers 48, platen roller 50 and each of the paired rollers on the horizontal transport portion 12 downstream of the turning portion 5 on the second card transport path P2 are rotatingly driven by the pulse motor M3 not shown in the drawings, via a plurality of gears. Note that in the image forming portion 10, the light emitting element and light receiving element for detecting the mark for positioning of the intermediate transfer sheet F are arranged on either side straddling the intermediate transfer film F between the guide roller 44 and guide plate 47.

Figure 3:
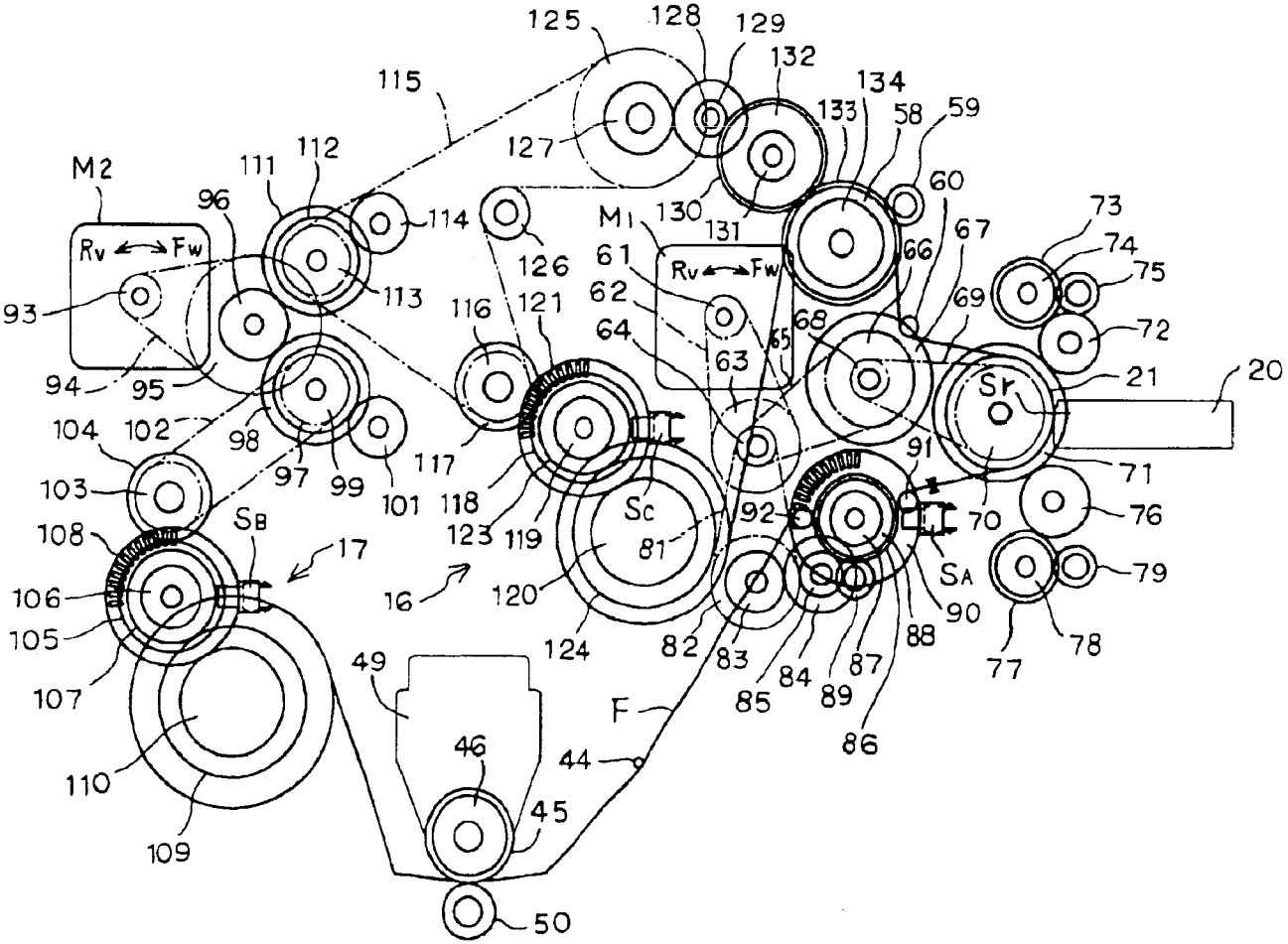
FIG. 3 is a front view showing the card transport mechanism near the intermediate transfer film transport mechanism and image forming portion of the printing apparatus.

As can be seen in FIG. 3, within the region of the frame 2, the first card transport path P1 and the second card transport path P2 shown in FIG. 2, the drive mechanisms that get their driving force from the reversible pulse motor M1 and the reversible pulse motor M2 are arranged. The timing pulley 61 hereinafter called the pulley) is mated to the motor shaft on the pulse motor M1 and an endless timing belt 62 (hereinafter called the belt) is trained between the pulley 61 and the pulley 63. To the pulley 63 shaft is mated the pulley 64 having a diameter smaller than the pulley 63.

To the pulley 64, the belt 65 is trained therebetween with the pulley 66. To the pulley 66 shaft is mated the solenoid clutch 67. The solenoid clutch 67 interlocks the rotational drive force of the pulley 66 to the pulley 68 which is mated to the solenoid clutch 67 when transporting the card C in a direct transfer, when directly transferring to the card C by the thermal head 20 and when forming an image on the intermediate transfer film F using the thermal head 20. The pulley 70 is mated to the same shaft as platen roller 21. The belt 69 is trained between the pulley 68 and the pulley 70. Additionally, to the platen roller 21 shaft is mated the gear 71 having a diameter greater than the platen roller 21. To the gear 71 are meshed the gears 72 and 76. The gear 72 meshes with the gear 73 that comprises on the same shaft the capstan roller 74 that presses against the pinch roller 75 and the gear 76 meshes with the gear 77 comprising on the same shaft the capstan roller 78 that presses against pinch roller 79.

Also, another belt, the belt 81, is trained to the pulley 64, transmitting rotational drive force to the pulley 82. To the pulley 82 shaft is mated the gear 83 that meshes with the gear 84. To the gear 84 shaft, the gear 85 having a diameter smaller than the gear 84, is mated. The gear 85 and the gear 86 are meshed. The torque limiter 87 is mated to the shaft of the gear 86, and rotational drive force is transmitted to the back-tension roller 88 via the torque limiter 87. The pinch roller 89 is pressed against the back-tension roller 88. To the same shaft as the back-tension roller 88 is mated the clock plate 90. While the intermediate transfer film F is being fed forward or in reverse, the back-tension roller 88 rotates in synchronization with the intermediate transfer film F. Near the clock plate 90 is arranged the unitized transmissive sensor SA that detects the amount of rotation of the clock plate 90 to control the amount of transport (the amount fed and the amount returned) of the intermediate transfer film F.

To the motor shaft of the pulse motor M2 is mounted the pulley 93. The belt 94 is trained between the pulley 93 and the pulley 95. The gear 96 is mounted to the pulley 95 shaft.

The drive from the gear 96 is transmitted in the counterclockwise direction and the gear 96 meshes with the one-way gear 97 mated to the shaft that is free (freely rotates) in the clockwise direction. To the shaft on the one-way gear 97, the gear 98 and pulley 99 are mounted. The gear 98 meshes with the one-way gear 101 that is free in the clockwise direction and locked in the counterclockwise direction. To the pulley 99, the belt 102 is trained therebetween with the pulley 103. To the pulley 103 shaft, the gear 104 is mounted and meshes with the gear 105. To the gear 105 shaft is mounted the torque limiter 106 which transmits rotational drive force to the gear 107. To the same shaft as the gear 107 is mounted the clock plate 108. The gear 107 meshes with the gear 109 that is mounted to the take-up spool shaft 110 which takes up the intermediate transfer film F. Near the clock plate 108 is disposed the unitized transmissive sensor SB that detects the amount of rotation of the take-up spool shaft 110, via the rotation of the clock plate 108. That detects any breakage in the intermediate transfer film F by detecting the rotation of the take-up spool shaft 110.

The gear 96 meshes with the one-way gear 111, which is mounted on the side opposite to the one-way gear 97. The one-way gear 111 is mounted to a shaft that is free in the counterclockwise direction and transmits drive from the gear 96 in the clockwise direction. To the shaft on the one-way gear 111, the gear 112 and pulley 113 are mounted. The gear 112 meshes in the clockwise direction with the one-way gear 114 that is free in the counterclockwise direction and locked in the clockwise direction. The belt 115 is between the pulley 113, the pulley 116 and the pulley 125. Note, to maintain a constant tension on the belt 115, the tension roller 126 is arranged between the pulley 116 and the pulley 125 which are linked by the belt 115. To the pulley 116 shaft, the gear 117 is mounted and meshes with the gear 118. To the gear 118 shaft is mounted the torque limiter 119 that transmits rotational drive force to the gear 123. To the shaft of the gear 123 is mounted the clock plate 121. The gear 123 meshes with the gear 124 that is mounted to the supply spool shaft 120 to supply the intermediate transfer film F. Near the clock plate 121 is arranged the unitized transmissive sensor SC that detects the rotation of the supply spool shaft 120, via the rotation of the clock plate 121, and that detects any breakage in the intermediate transfer film F by detecting the rotation of the supply spool shaft 120. Note that the intermediate transfer film supply portion 16 is mounted to the supply spool shaft 120, and that the intermediate transfer film take-up portion 17 is mounted to the take-up spool shaft 110.

The drive from the pulley 113 is transmitted to the pulley 125, via the belt 115. To the pulley 125 shaft, the gear 127 is mounted. The gear 127 meshes with the gear 128. Still further, drive is transmitted to the gear 130 via the gear 129 which is disposed on the same shaft as the gear 128. To the pulley 130 shaft is mounted a solenoid clutch 131. The solenoid clutch 131 interlocks the rotational drive force of the gear 130 to the gear 131 via the gear 132 that is mounted to the shaft of the solenoid clutch 131 only when rewinding (Rv) the intermediate transfer film F. To the gear 133 shaft is mounted the torque limiter 134. The rotational drive force is transmitted via the torque limiter 134 to the transport roller 58 that transports the intermediate transfer film F. Note that the speed that the supply spool shaft 120, the platen roller 21 and the transport roller 58 transport the intermediate transfer film F when the solenoid clutch 131 drive is engaged is set so that the speed of the supply spool shaft 120 is higher than the transport roller 58 which is higher than the platen roller 21. Torque control is set so that the platen roller 21 is greater than the transport roller 58 which is greater than the supply spool shaft 120.

The feeding (Fw) and rewinding (Rv) of the intermediate transfer film F is primarily achieved by switching the direction of rotation of the pulse motor M2. When forming images on the intermediate transfer film F while the intermediate transfer film F is being rewound (Rv), the supply spool shaft 20, the platen roller 21 and the back-tension roller 88 are set so that they have the following relationship for the transport speed of the intermediate transfer film F. The supply spool shaft 20 is faster than the platen roller 21 which is faster than the back-tension roller 88. For that reason, when the thermal head 20 is separated and the intermediate transfer film F is fed, drive is cut by the solenoid clutch 67 to prevent slackening of the intermediate transfer film F.

As can be seen in FIG. 2, formed on the line extended in the direction of arrow L on the second card transport path P2 in the frame 2 is the discharge outlet 27 that discharges the cards C that have been finished printing, to outside of the frame 2. Below the discharge outlet 27, removably mounted from the frame 2 is the stacker 13 that stacks the cards C. Note that the unitized transmissive sensor S5 is arranged between the cleaner 4 and the transfer portion 5, the transmissive sensor S6 is arranged on the capstan roller 78 side near the turning portion 5, the unitized transmissive sensor S7 is arranged between the capstan roller 78 and the thermal head 20, the unitized transmissive sensor S8 is arranged on the side of the paired horizontal transport rollers 11 near the paired transport rollers 48, the unitized transmissive sensor S9 is arranged on the paired discharge rollers 142 side near the paired rollers that have no drive that are arranged between the paired capstan rollers 141 and the paired discharge rollers 142, and the unitized transmissive sensor S10 (not shown in the drawings) are between the horizontal transport portion 12 and discharge outlet 27. These detect the leading edge or the trailing edge of the card C being transported along the first card transport path P1 or the second card transport path P2. Note that in the following description, as a reference for the direction of transport for the card C, the leading edge of the card in the direction of its transport means the leading edge and its trailing edge in the direction of its transport means its trailing edge.

Furthermore, as shown in FIG. 2, in the frame 2, the image forming apparatus 1 comprises the power supply unit 18 that converts commercial alternating current power into drive/operable direct current power for each mechanism and control unit. It also comprises the control unit 19 which controls the entire operation of the image forming apparatus 1, and a touch panel 8 on the upper portion of the frame 2 that displays the status of the image forming apparatus 1, and that allows an operator to manually input instructions to the control unit 19 according to the information received from the control unit 19.

Figure 5:
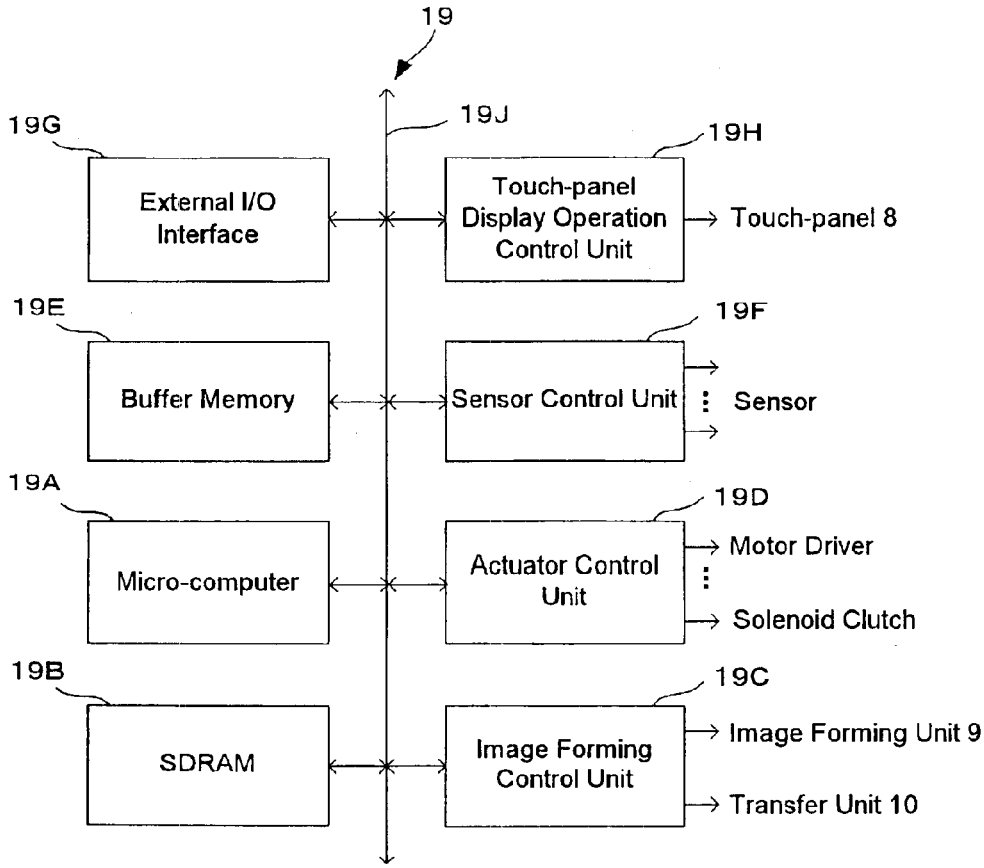
FIG. 5 is a block diagram of the general configuration of the printing apparatus control unit.

As shown in FIG. 5, the control unit 19 comprises the microcomputer 19A as the image variable magnification means and the image printing mode selection means that control the printing apparatus 1. The microcomputer 19A comprises a CPU that operates with a fast clock speed as the central processing unit, a ROM that stores with control operations for the printing apparatus 1 and an internal bus that connects the RAM and these to work using the work area on the CPU.

The external bus 19J is connected to the microcomputer 19A. Connected to the external bus 19J are the touch-panel display operation control unit 19H that controls the display and operating instruction of the touch panel 8, the sensor control unit 19F that controls the signals from each sensor, the actuator control unit 19D that controls the motor driver for outputting the drive pulses to each motor and controls to turn the solenoid clutch on and off, the external I/O 19G that communicates with the PC, the buffer memory 19E that temporarily stores the image data to be printed on the card C, the image forming control unit 19C that controls the thermal energy of the thermal head 20 on the image forming portion 9 and the heating lamp 46 on the transfer potion 10, and the SDRAM image memory) 19B that stores the image data received from the PC and the image data after the gradation correction, which is described below. The touch-panel display operation control unit 19H, the sensor control unit 19F, and the image forming control unit 19C are each connected to the touch panel 8, the sensors including Sa to Sc and S1 to S11, the drivers that drive the pulse motor drivers of M1 to M3, the solenoid clutches 67 and 131, and the thermal head 20 and heating lamp 46.

The following shall describe the operations of the printing apparatus 1 in this printing system focusing on the CPU of the microcomputer 19A in the control unit 19, in reference to the flow charts.

Figure 6:
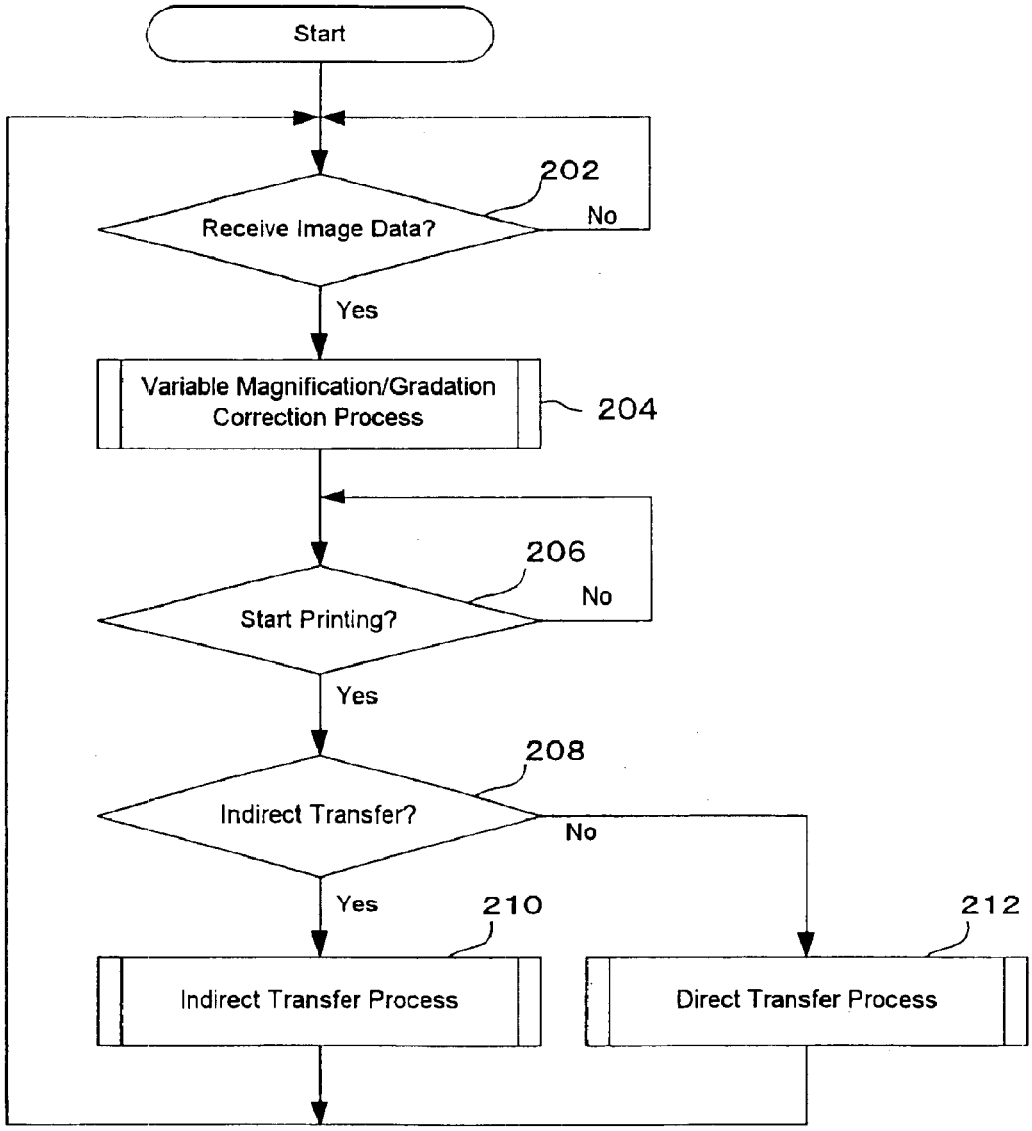
FIG. 6 is an image forming routine flowchart executed by the printing apparatus control unit CPU.

As shown in FIG. 6, when the power is turned on for the printing apparatus 1, the CPU can execute an image forming routine for forming images on the card C using either the direct transfer method or the indirect transfer method. Initially, in the image forming routine, the system waits to receive the image data from the PC at step 202. When the image data is received, at step 204, the system then executes a variable magnification (enlarging or reducing) on the image data and a variable magnification/gradation correction process subroutine to correct the gradation of the image data after variable magnification.

Figure 7:
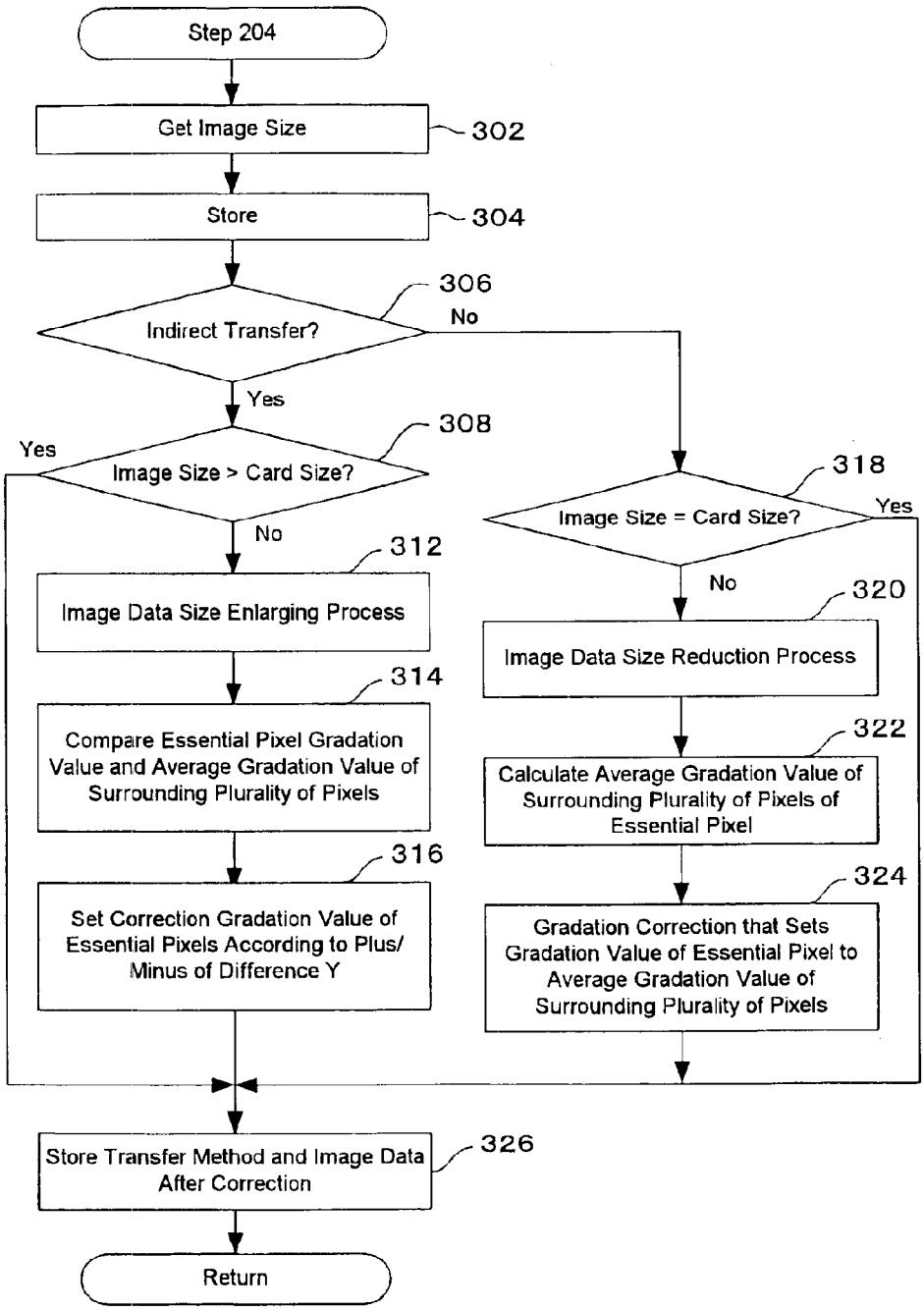
FIG. 7 is a flowchart of a subroutine of the variable magnification and gradation value correction showing the details of step 204 of the image forming routine.

As can be seen in FIG. 7, at this variable magnification/gradation correction process subroutine, at step 302, the system gets the image size in the main scanning (the shorter direction) and in the sub-scanning direction (the longer direction). It is also acceptable to get the image size from the header field information for the image data. Next at step 304, the image data received from the PC is stored in the SDRAM 19B via the external I/O interface 19G and the buffer memory 19E.

Next, at step 306, the system determines whether to indirectly transfer the image to the card C according to the image data. It is acceptable for that to be determined by receiving from the PC mode specification signals that specify the direct transfer mode as the first image printing mode or the indirect transfer mode as the second image printing mode. It can also be determined according to the specification that an operator could manually input on the touch-panel 8 for the direct transfer mode or the intermediate transfer mode. Furthermore, it is possible for the CPU to determine the mode regardless of the information input from the PC or the touch-panel 8. Specifically, if the light emitting and receive elements that are arranged between the guide roller 44 and the guide plate 47 do not detect the intermediate transfer film F then it can determined that the mode will be direct transfer. If it is detected, it is determined that the mode will be indirect transfer.

Figure 10A:
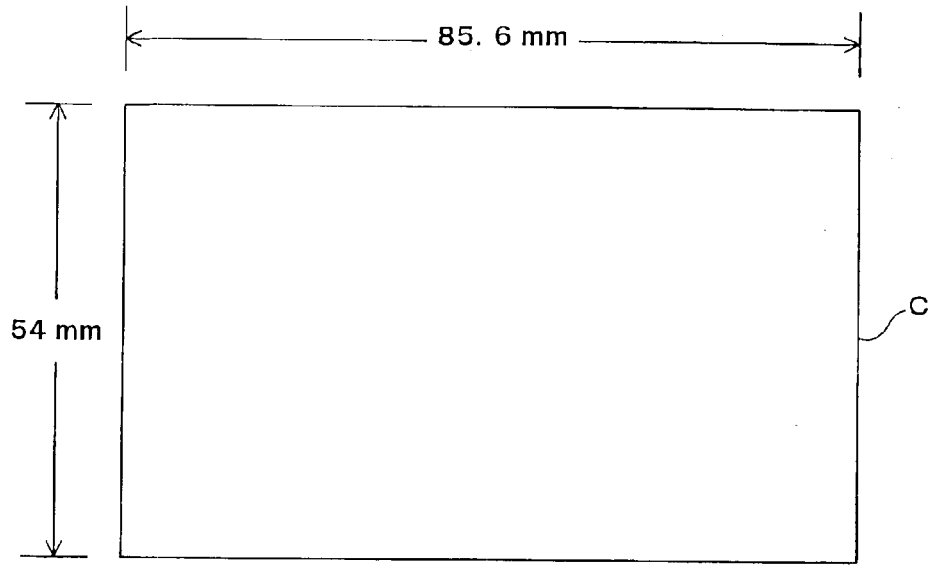
FIG. 10A and FIG. 10B are drawings showing an image printed on a card.
Figure 10B:
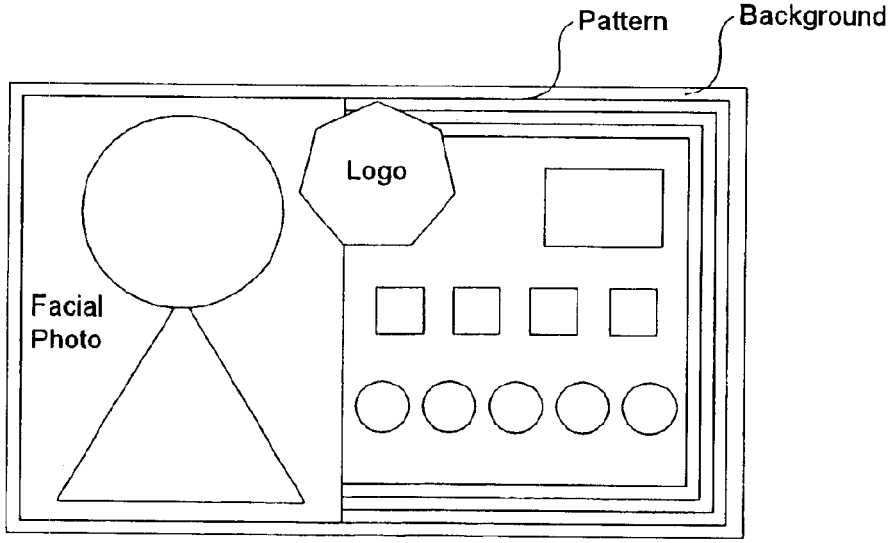

At step 306, if the detection is affirmative, (or indirect transfer), the system determines, at step 308, whether the image size is larger than the pre-input card size (the predetermined dimension of the card C). If the detection is negative, the system proceeds to step 326 keeping the image at the same magnification, without enlarging the image size. The system then proceeds to step 312 when negatively determined.

at step 312, the system enlarges the image data stored in SDRAM 19B. In FIG. 10A, the most common card size, for cards used as IDs, etc., is 54 mm in the vertical direction, which is the main scanning direction for the thermal head 20 (or the shorter direction) and 85.6 mm in the horizontal direction (or the longer direction), which is the sub-scanning direction (line direction) with regard to the thermal head 20. Therefore, the ratio for the vertical vs horizontal directions of the most common ID card is 1:1.585 (vertically vs horizontally). Also, FIG. 10B conceptually shows a typical data layout when printing and issuing an ID card. If the ID card is going to be used by a company employee, for example, the card can be printed with that person's photograph, the company log, personal information about that person in the squares and circles (such as the company name, the section to which that person belongs, their company ID number, or their name, etc.). If necessary, line patterns or background images on the edges can also be arranged. As just described, in recent times, these cards that can be freely laid out using a PC with a variety of information and printed to the entire surface can be used in a variety of ways, as ID cards.

Figure 11A:
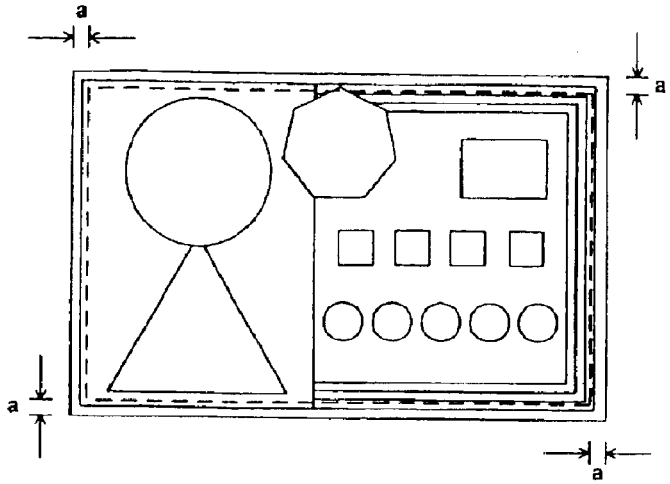
FIG. 11A and FIG. 11B are drawings showing image data printed with the vertical and horizontal ratios varied.
Figure 11B:
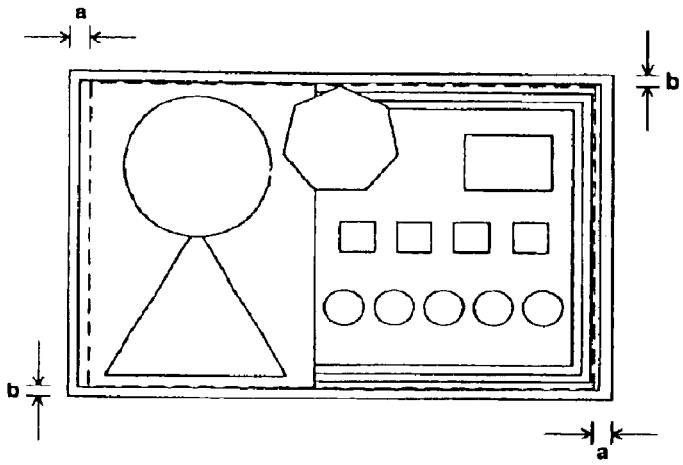

FIG. 11A and FIG. 11B are models to conceptualize the enlarging of image data that is stored on the SDRAM 19B, at step 312. The area indicated by the broken line is the original size of the image data before being enlarged), and is the same size as the card C. FIG. 11A shows the original image data enlarged to the same dimensions (dimensions a in the drawing) in both the horizontal and vertical directions of the card C. In this case, as described above, the card has the ratio of 1:1.585 with the dimensions of 54 mm:85.6 mm. Therefore, the image data cannot be enlarged equally for both the horizontal and vertical directions, but the enlarged image will be slightly elongated (for example, a circle becoming slightly arced) so the image data will not appear correctly, thereby causing the problem of an unnatural look.

Conversely, FIG. 11B shows the original image data vertical and horizontal dimensions enlarged to correspond to the card vertical and horizontal dimensions. This enlarges the dimension b, the vertical direction of the image that corresponds to the vertical direction of the card, in the main scanning direction for the thermal head 20. Also, the dimension a, the horizontal direction of the image that corresponds to the horizontal direction of the card, is enlarged in the sub-scanning direction for the thermal head 20. In this case, the image data is enlarged with the relationship of dimension a:dimension b=1:1.585, so the original image data ratio for enlargement is equal in the vertical and horizontal directions. This eliminates the problem mentioned above in that a circle in the original image becomes arced. Also, unnatural appearances of the subject do not exist in the image. However, because the region that is cut off (or in other words, that portion is not transferred to the card C) in the horizontal direction is larger than the region in the vertical direction which is the main scanning direction, the problem occurs that a portion of patterns in the image that is finally transferred from the intermediate transfer film which is the sub-scanning direction, such as the lines arranged on the edge of the card are not formed. This also causes a feeling of incongruity to the final look of the card.

Therefore, according to this embodiment of the invention, it is possible to vary the enlarging ratio for the vertical and horizontal sizes of the image data within the range of the size ratio for the card in the vertical and horizontal directions. Specifically, at step 312, the image data as represented by either FIG. 11A or FIG. 11B is enlarged. The enlarged image data is then sent to the PC where the operator can check the image after it has been enlarged, via the PC display (or the touch-panel 8). If the operator desires to change the enlarging ratio of the image data, they can load that ratio in from the PC and display the image again on the PC (or the touch-panel 8) and repeat checking the image after it has been enlarged. When the operator has attained his desired enlargement ratio for the image data, he can press the return key on the keyboard of the PC to receive that signal.

Continuing, at step 314 and step 316, if the enlargement is performed under the fixed resolution conditions such as those of step 312, the trends of the variation in the gradation will be loose, which will cause the edges of the final image (the contours and boundaries) to be blurred and the final image quality to be blurry. To correct this, a contour enhancing process is applied to each pixel of the image data.

Figure 12:
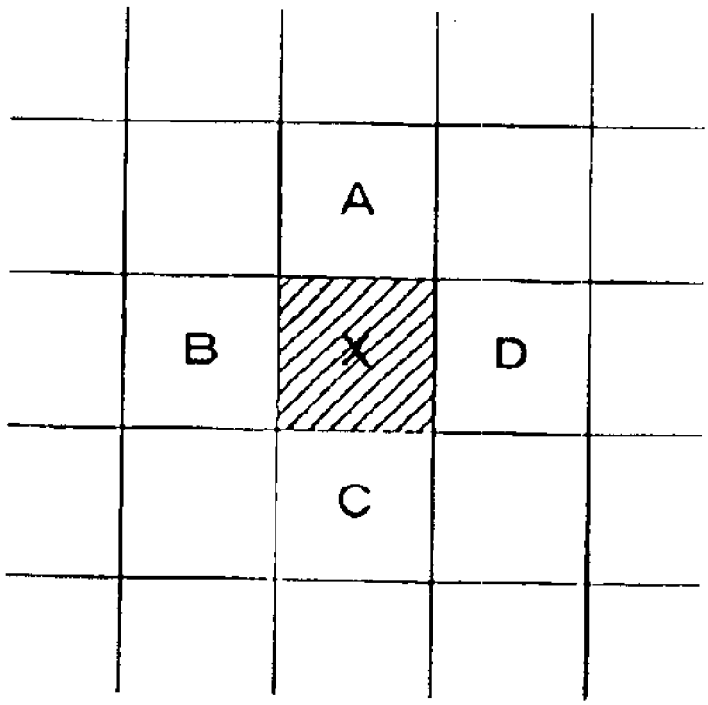
FIG. 12 is a drawing showing the relationship of essential pixel and surrounding pixels when correcting gradation.

At step 314, the system compares the gradation value of the essential pixel and the average values of the surrounding plurality of pixels. Specifically, as shown in FIG. 12, if the essential pixel is X, for example, and the adjacent pixels in the main and sub-scanning directions are A, C, B and D, the system compares the gradation value of the essential pixel X and the average gradation values of the surrounding pixels of A to D to calculates the difference Y for both gradation values. To describe in more detail, the gradation value of the essential pixel X and the average gradation value of the surrounding pixels are made to correspond as: (average gradation value of the surrounding pixels)−(gradation value of the essential pixel)=(difference Y), so it is possible to find the difference with $[(A+B+C+D)/4]-X=Y$.

Next, at step 316, the system determines whether the average gradation values of the surrounding pixels are smaller than the gradation value of the essential pixel X (difference $Y<0$). If affirmative, the value with the difference Y added to the essential pixel X (X+Y) is set as the correction gradation value for the essential pixel X. If negative, the value with the difference Y subtracted from the essential pixel X (X−Y) is set as the correction gradation value for the essential pixel X. This process is performed on all pixels for the image data. Thus, the contour of the essential pixel X further enhanced by providing a value larger than the average values of the surrounding pixels when the difference Y is less than 0. When an image is printed on the card C, blurriness in the image quality is eliminated. If the difference Y is larger than 0, the contour is even further enhanced by providing a value that is even smaller than the surrounding pixels' average gradation value. This, too, eliminates any blurriness to the image quality. Therefore, at step 316 the gradation value for all pixels in the enlarged image data are corrected thereby alleviating blurriness in the image quality when the image is formed on the card C. Note that when Y=0, gradation correction is unnecessary, so no settings are made to the correction gradation value for the corresponding essential pixel X. Furthermore, the embodiment described herein uses means for comparing the gradation value of essential pixels and the average values of a plurality of surrounding pixels as the gradation correction for enlarged images, but as shown in FIG. 16A, FIG. 16B and FIG. 16C, means are not limited to this. It is also possible to employ means that use the difference of two times (or the differential of two times—the same applies below), a method which is known in the art. Specifically, it is possible to enhance the contours of the image by using the difference of two times to find the point of variation of the gradation value between adjacent pixels. By applying the values found using the difference of these two times, or predetermined values as correction values to the pixels that exist at those point of variation, a correction process that establishes the trend in the gradation variations (to make the trend more distinct) can be employed in the same way (see FIG. 16D). Note that in FIG. 16D, the variation in gradation of the original image data is shown using the single-dotted lines, and the variation in gradation after gradation correction has been applied using the contour enhancing process is indicated by the double-dotted lines.

At step 326, default values representing the transfer method (indirect transfer method) is stored in RAM. Image data whose gradation was corrected at step 316 is stored in SDRAM 19B. After completing the variable magnification/gradation correction sub-routine, the system proceeds to step 206, which is shown in FIG. 6.

When the decision at step 306 is negative (or direct transfer), it is determined whether the image size is the same as the card, at step 318. If the decision is affirmative, there is no need to change the size of the image data, so the system proceeds to step 326, and stores the default values representing the transfer method (direct transfer) stored in RAM. Image data that was stored in SDRAM 19B at step 302 completes the variable magnification/gradation correction sub-routine as it is, then the system proceeds to step 206, which is shown in FIG. 6. If the decision is negative, the system reduces the image data stored in SDRAM 19B, at step 320. In the same way as at step 312, the user reduces the image data to the desired size using the reducing process.

Then, at steps 322 and 324, smoothing is performed on all pixels of the image data that was reduced at step 320. In other words, when the reducing process is performed on the image data using an algorithm, like the one described in U.S. Pat. No. 2,736,803, the trend of the gradation values will be sharp with the conditions of a constant resolution which will result in drastically sharp edges (contours and boundaries) making the image too sharply contrasted and grainy in appearance. That is why smoothing is performed to remove that graininess in appearance when the image is printed to the card C.

At step 322, the system calculates the average gradation value of the surrounding plurality of pixels of the essential pixel for all pixels composing the reduced image data. Specifically, to explain according to the example in FIG. 12, the system finds [(A+B+C+D)/4] for the essential pixel X. At step 324, the corrected gradation value of the essential pixel X is set to [(A+B+C+D)/4] which is the surrounding average gradation value. At step 326, the default value representing the transfer method (direction transfer) is stored in RAM. The image data whose gradation was corrected at step 324 is stored in SDRAM 19B. After completing the variable magnification/gradation correction sub-routine, the system proceeds to step 206, which is shown in FIG. 6.

At step 206 in FIG. 6, the system waits until the printing start instruction from either the PC or the touch-panel 8. When the instruction is received, at step 208, it determines whether the transfer method stored in RAM at step 320 is indirect transfer. If affirmative, at step 210, the indirect transfer process sub-routine is performed to form the images on the card C using the indirect transfer method.

Figure 8:
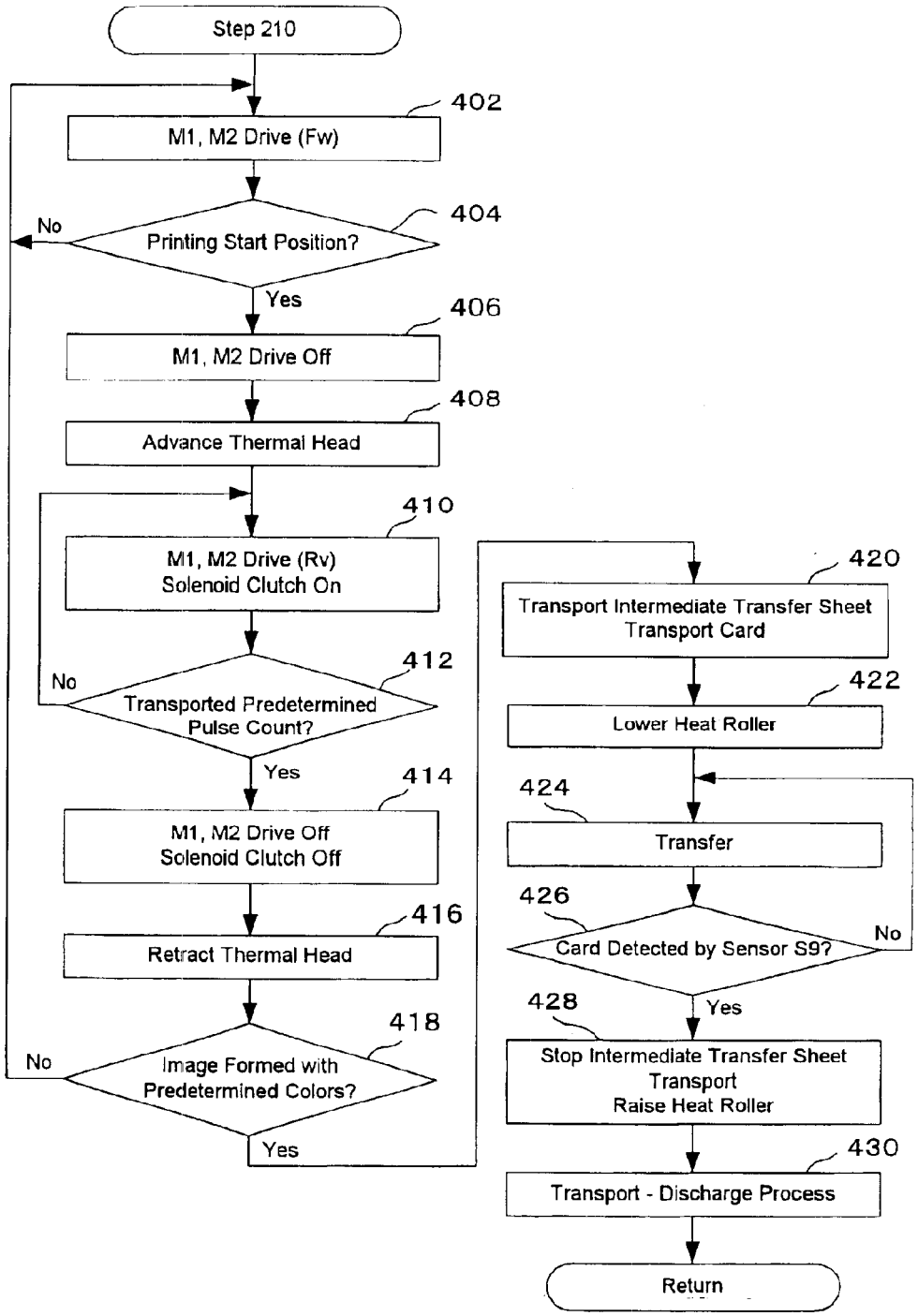
FIG. 8 is a flowchart of a subroutine of the indirect transfer process showing the details of step 210 of the image forming routine.

As shown in FIG. 8, at step 402 in the indirect transfer process sub-routine, the pulse motors M1 and M2 rotate in the feed direction (Fw). At step 404, the mark for positioning formed on the intermediate transfer film F is recognized by monitoring the light reception sensor S2. They system then determines whether the intermediate transfer film F has been transported to the printing starting position by detecting the amount of rotation of the clock plate 90 connected to the back-tension roller 88 that constantly reversibly rotates as a single unit with the feeding and returning of the intermediate transfer film F. If negative, the system returns to step 402 and continues transporting the intermediate transfer film F. If affirmative, the drive of the pulse motors M1 and M2 are turned off at step 406. During that time, the thermal head 20 is positioned away from the platen roller 21 and the starting edge of for example Y (yellow) on the thermal transfer film R is fed a predetermined distance to the printing position Sr. Such control is executed by detecting the trailing edge of the Bk (black) portion on the thermal transfer film R using the light emitting sensor S4, and by detecting the rotation of the clock plate, not shown in the drawings, established near the paired take-up rollers 57 using the unitized transmissive sensor, not shown in the drawings, to detect the distance from the trailing edge of the Bk (black) portion, having a predetermined width on the thermal transfer sheet R, to the Y (yellow) portion on the thermal transfer sheet R.

Next, at step 408, the thermal head sliding cam 23 is rotated in the direction of the arrow A to touch the thermal head 20 against the platen roller 21 interposed therebetween by the thermal transfer film R and the intermediate transfer film F. Next, at step 410, while rotating the pulse motor M1 and the pulse motor M2 in the take-up (Rv) direction, the platen roller 21 is rotated in the counterclockwise direction by the interlocking of the solenoid clutches 67 and 131. This rotates the transport roller 58 in the counterclockwise direction. This starts the forming of the image using the color Y (yellow) on the intermediate transfer film F. In other words, the thermal head 20 heats the Y (yellow) ink layer on the thermal transfer film R, thereby starting to form the image on the receptive layer Fe on the intermediate transfer film F. The driving force provided by the pulse motor M1 rotates the platen roller 21 in the counterclockwise direction and the driving force of the pulse motor M2 takes up the intermediate transfer film F using the intermediate transfer film supply portion 16. In synchronization to that, the thermal transfer film R is taken up by the thermal transfer film take-up portion 15.

By determining whether the pulse motor M1 has rotatingly driven the predetermined number of pulses that correspond to the size of the length direction of the image formed on the intermediate transfer film F at, step 412, it is determined whether the forming of the image on the intermediate transfer film F has been completed. When it is negative, the system returns to step 410 and continues forming the image on the intermediate transfer film F. If affirmative, along with stopping the drive of both the pulse motor M1 and M2 at the step 414, it releases the interlock of the solenoid clutches 67 and 131 on the platen roller 21 and transport roller 58. Note that the CPU reads out the image data that was stored in SDRAM 19B at step 326 in the direction opposite to that direction that it was stored (the starting edge of storage being used as the ending edge for the data read out, and the ending edge for storing being used as the starting edge for data read out) and converts each line of the image data (or a plurality of lines) into thermal energy via the image forming control unit 19C and reads out to the thermal head 20 that mirrored print data applying a predetermined coefficient to that thermal energy according to the type of intermediate transfer film F being used. The printing elements of the thermal head 20 are heated according to this printing data.

At step 416, the thermal head sliding cam 23 rotates to retract the thermal head 20 from the platen roller 21. At step 418, it determines whether the forming of the image for the prescribed colors (YMC) has been completed. If negative, the system returns to step 402 to form the image overlaying the color already formed on the receptive layer on the intermediate transfer film F (for example, Y) with the next color (for example, M). If affirmative, in other words, if it is determined that the forming of the image using the colors YMC has been completed, the system proceeds to step 420. This forms a mirror image of a size larger than the card C on the intermediate transfer film F.

At the next step of 420, the pulse motor M2 is driven to transport the intermediate transfer film F to the heat roller 45 position already separated from the platen roller 50, according to the amount of rotation of the clock plate mounted onto the back-tension roller 88. When transporting, it is possible to reset the amount of transport to improve the transporting accuracy of the intermediate transfer film F positioning by monitoring output from the light receiving sensor arranged between the guide roller 44 and the guide plate 47 in the transfer portion 10 and detecting the mark for positioning the intermediate transfer film F. Also, at step 420, in parallel to transporting the intermediate transfer film F to the transfer portion 10, the card C is fed from the card supply portion 3 along the second card transport path P2 until the leading edge thereof touches the heat roller 45. Specifically, while rotatingly driving the card supply portion 3, the cleaner 4 and the pinch rollers 38 and 39 on the turning portion 5, the pulse motor M3, not shown in the drawings, drives to rotate the paired horizontal transport rollers 11, the paired transport rollers 48 and each of the rollers on the horizontal transport portion 12. This sends one card C from the card supply portion 3 to the second card transport path P2 where both surfaces of the card C are cleaned by the cleaner 4. When the unitized transmissive sensor S5, not shown in the drawings, detects the leading edge of the card C, it stops the rotation of the kick roller 31. Continuing, the card C is transported further in the direction of the arrow L through the turning portion 5 along the second card transport path P2. When the unitized transmissive sensor S7, not shown in the drawings, arranged on the paired horizontal transport rollers 11 side near the transport roller 48 detects the leading edge of the card C, the card is transported further a determined number of pulses in the direction of the arrow L. This transports the card C to a position where the leading edge touches the heat roller 45. Note that the point at which the unitized transmissive sensor S8, not shown in the drawings, detects the leading edge of the card C, the rotational drive of the pinch rollers 38 and 39 is turned off.

Next, at step 422, the heat roller elevator cam 51 is rotated in the direction of the arrow B to shift the heat roller 45 from a separated state from the platen roller 50 (see FIG. 14A) to touch the platen roller 50 (see FIG. 14B). Then the rotation of the heat roller elevator cam 51 stops. At this point, the leading edge of the card C touches the heat roller 45, while a side of the card C is supported by the platen roller 50 and the intermediate transfer sheet F is interposed between the other side of the card C and heat roller 45.

Next, at step 424, images that are formed on the reception layer Fe on the intermediate transfer film F at the image forming portion 9 are indirectly transferred to one side of the card C using the thermal transfer and pressure of the heat roller 45. To describe the operations that occur here at step 424 in more detail, the card C, the other side thereof supported by the platen roller 50 that rotates in the counterclockwise direction, is touched to the heat roller 45 with one surface interposed by the intermediate transfer sheet F and is transported in the direction of the arrow L. The peeling layer Fc on the intermediate transfer film F is peeled away from the base film Fa by the heat of the heating lamp 46 and through the pressure of the heat roller 45. The layer Fe formed thereupon with images and the overcoat layer are transferred to the other side of the card C as a single body. In synchronization to this transfer, the intermediate transfer film F is taken up by the intermediate transfer film take-up portion 17. During this time, at step 426, by monitoring whether or not the leading edge of the card C is at the unitized transmissive sensor S9 arranged on the paired discharge roller 142 side near the paired rollers that have no drive arranged between the capstan rollers 141 and the paired discharge rollers 142, the system determines whether indirect transfer has been completed. If not completed, it returns to step 424 and continues the indirect transfer. If indirect transfer has been completed, it proceeds to the next step of 428. Images are formed with the positive image to the entire surface (all areas) of the card C through the transfer that occurs at the transfer portion 10. Note that the transport of the card C and the intermediate transfer film F during indirect transfer are the same speed.

At step 428, by stopping the drive of the pulse motors M2 and M3, the feeding transport of the intermediate transfer film F rewinding to the intermediate transfer film take-up portion 17) and the transport of the card C in the direction of the arrow L are stopped. The heat roller elevator cam 51 is re-rotated to retract the heat roller 45 from the platen roller 50. Then, at step 430, the system executes the transport/discharge process that transports the card C over the second card transport path P2 and discharges it outside of the printing apparatus 1.

In the transport/discharge process that is performed at step 430, the pulse motor M3, not shown in the drawings, drives to transport the card C further in the direction of arrow L along the second card transport path P2. It is determined whether the unitized transmissive sensor S10, not shown in the drawings, arranged between the horizontal transport portion 12 and the discharge outlet 27 has detected the leading edge of the card C. If negative, the card is transported further. If affirmative, transport continues for a predetermined amount of time to completely discharge the card C outside of the frame 2. This discharges the card C to the stacker 13 via the discharge outlet 27. Next, the rotational drive of the pulse motor M3, not shown in the drawings, is stopped and the pulse motors M1 and M2 are driven in reverse. It is determined by the unitized transmissive sensor SA, described above, whether the intermediate transfer film F has been transported the predetermined distance. If negative, the system continues to transport the intermediate transfer film F. If affirmative, the system stops the drives of the pulse motors M1 and M2, completes the indirect transfer sub-routine and returns to step 202.

If the decision is affirmative (direct transfer) at step 208 in FIG. 6, the direct transfer sub-routine for forming images on the card C using the direct transfer method is executed at step 212.

Figure 9:
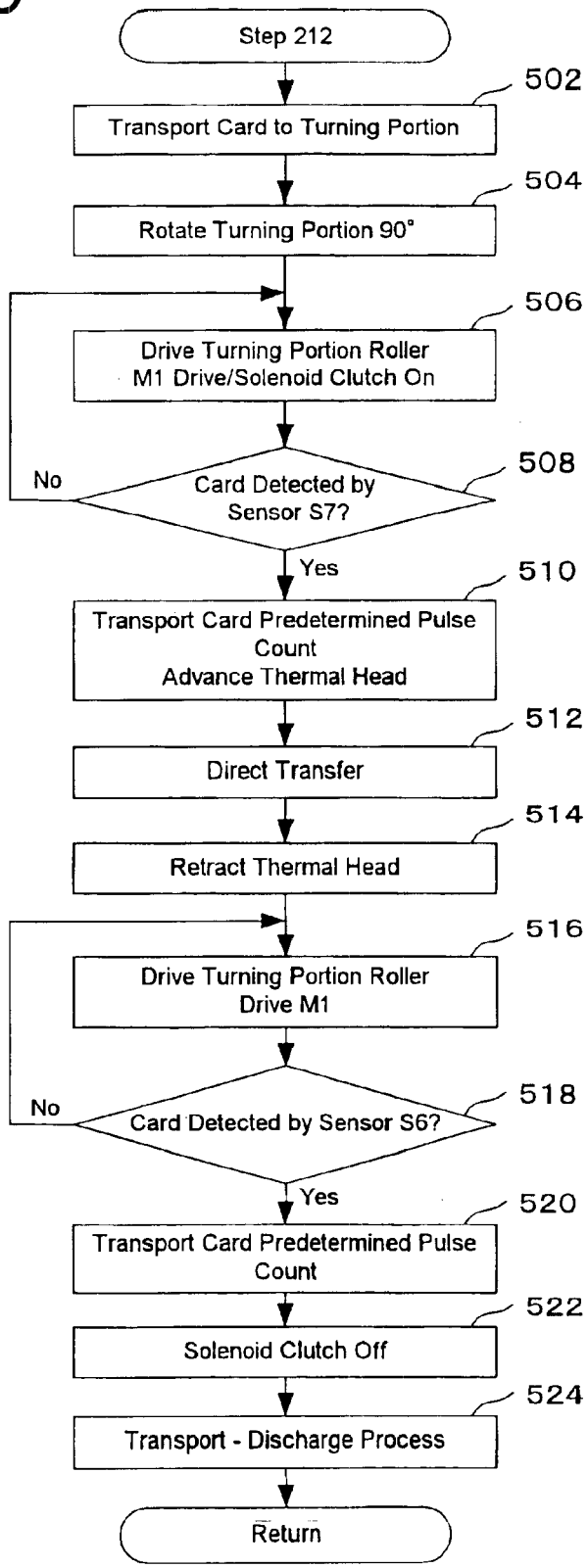
FIG. 9 is a flowchart of a subroutine of the direct transfer process showing the details of step 212 of the image forming routine.

As shown in FIG. 9, in the direct transfer sub-routine the card supply portion 3 arranged on the second card transport path P2, the cleaner 4 and each of the rollers on the turning portion 5 operate at step 502 to transport the card C from the card supply portion 3 in the direction of the arrow L and nip the card C in the pinch rollers 38 and 39 on the turning portion 5. In other words, by rotating the kick roller 31 on the card supply portion 3, the bottommost card C in the card stacker is fed to the second card transport path P2 whereat both sides of the card C are cleaned by the cleaning roller 34 on the cleaner 4. When the leading edge of the card C has been detected by the unitized transmissive sensor S5, not shown in the drawings, arranged between the cleaner 4 and the transfer portion 5, the rotation of the kick roller 31 on the card supply portion 3 is stopped. The card C is stopped after it is transported a predetermined number of pulses after passing the position where it was detected by the unitized transmissive sensor S5 to the turning portion 5 (the rotational drive of the pinch rollers 38 and 39 is also stopped) and the horizontally oriented turning portion 5 nips both ends of the card C.

Next, at the step 504, the turning portion 5 is rotated 90° to become vertically oriented (see the dotted lines in FIG. 1) to transport the card C in the direction of the arrow U over the first card transport path P1. Next, at step 506, while rotatingly driving the pinch rollers 38 and 39, the system starts rotatingly driving the pulse motor M1 to the pulse motor M1 motor driver while the solenoid clutch 67 transmits drive force from the pulse motor M1 to the platen roller 21. Through this, the rotational drive of the pinch rollers 38 and 39, the platen roller 21, and the capstan rollers 74 and 78 is started to begin the transport of the card C to the image forming portion 9 along the first card transport path P1. Also, the transport is started for the intermediate transfer film F toward the intermediate transfer film supply portion 16 (to be rewound).

At the next step 508, the system determines if the unitized transmissive sensor S7, not shown in the drawings, which is arranged between the capstan roller 78 and the thermal head 20 has detected the leading edge of the card C. If negative, the system returns to step 506 and continues the transport of the card C to the image forming portion 9. If affirmative, at step 510, it transports the card C a predetermined number of pulses in the direction of arrow U until the leading edge of the card C reaches the printing position Sr. The pinch rollers 38 and 39 on the turning portion 5 stop rotating at the point when the unitized transmissive sensor S6, not shown in the drawings, arranged between the turning portion 5 and the image forming portion 9, detects the trailing edge of the card C. During that time, the thermal head 20 is positioned away from the platen roller 21 (see FIG. 13A) and the starting edge of Bk (black) of the thermal transfer film R is fed a predetermined distance to the printing position Sr. Next, at step 510, the rotation of the thermal head sliding cam 23 is started in the direction of arrow A. This supports the other side of the card C at the platen roller 21 interposed by the intermediate transfer film F. One side touches the thermal head 20 interposed by the thermal transfer film R.

Continuing, at step 512, images are formed on the one side of the card C using the direct transfer method. The CPU reads out the reduced size or magnified image data stored in SDRAM 19B at step 326 in the same direction that it was stored and the sub-scanning direction, and converts each line of the image data (or a plurality of lines) into thermal energy via the image forming control unit 19C and sends to the thermal head 20 the positive image data applying a predetermined coefficient to that thermal energy according to the type of card C being used. The printing elements of the thermal head 20 are heated according to this printing data. The pulse motor M1 drive rotates the platen roller 21 in the counterclockwise direction. In synchronization to that, the thermal transfer film R is taken-up by the thermal transfer film take-up portion 15 and images, such as cautions for use, are formed (printed) to one side of the card C in Bk (black) using the direct transfer method. This forms positive images to the entire surface (all areas) of the card C. Note that the intermediate transfer film F is transported at the same speed as the thermal transfer film R and the card C.

At the next step 514, the thermal head sliding cam 23 is rotated in the direction opposite to the arrow A to retract the thermal head 20 from the card C. At step 516, after reversingly driving the pinch rollers 38 and 39, the reverse drive of the pulse motor M1 is started to reversingly rotate the platen roller 21 and the capstan rollers 74 and 78, thereby transporting the card C in the direction of the arrow D.

At step 518, the system determines whether the trailing edge of the card C has been transported to the position of the unitized transmissive sensor S6, which is not shown in the drawings. If it is negative, the system returns to step 516 and continues to transport the card C in the direction of the arrow D. If affirmative, at the next step 520, it transports the card C a predetermined number of pulses further in the direction of the arrow D. Next, at step 522, when the drive of the pulse motor M1 is stopped, the system stops the interlock to the platen roller using the solenoid clutch 67. The reverse rotation of the pinch rollers 38 and 39 in the vertically oriented turning portion 5 is stopped to nip both edges of the card C therein. At step 524, the system executes the transport/discharge process to transport the card C over the second card transport path to outside of the printing apparatus 1.

In the transport/discharge process at step 524, the vertically oriented turning portion 5 is rotated 90° to allow the card C positioned on the first card transport path P1 to be transported in the direction of the arrow L on the second card transport path P2. This positions the card C with the other side facing upward, on the second card transport path P2. Next, the pulse motor M3, which is not shown in the drawings, drives to transport the card C further in the direction of arrow L along the second card transport path P2. The system determines whether the unitized transmissive sensor S10, which is not shown in the drawings, arranged between the horizontal transport portion 12 and the discharge outlet 27 has detected the leading edge of the card C. If negative, the card is transported further. If affirmative, transport continues for a predetermined amount of time to completely discharge the card C outside of the frame 2. Then, the rotating drive of the pulse motor M3 is stopped, the direct transfer sub-routine is completed and the system returns to step 202. This discharges the card C to the stacker 13 via the discharge outlet 27. Note that the point at which the unitized transmissive sensor S8, not shown in the drawings, detects the leading edge of the card C, the rotational drive of the pinch rollers 38 and 39 is turned off. Also, in direct transfer, as shown in FIG. 14A, the heat roller 45 on the transfer portion 10 remains separated from the platen roller 50.

The printing apparatus 1 comprising the printing system of the present embodiment prints positive images to the entire surface of the card C by directly transferring the thermal sublimate ink on the thermal transfer film R. Specifically, as shown in FIG. 15A, the system forms (prints) positive images (step 512) to the entire surface of the card C by thermally transferring images according to the image data A which the same size as the card C, using either the equivalent or reduced image data (steps 318 and 320). On the other hand, to print to the entire surface of the card C using indirect transfer, the intermediate transfer film F reduces from the heat at the image forming portion 9. Also, the positioning with the card C to which the images are to be finally formed is extremely difficult (precise transport) because the intermediate media of the intermediate transfer film F is an added process. Therefore, after forming a mirrored image of the image data B (steps 402 to 418) generated with a size larger than the card C (or a size equivalent to the card C), as shown in FIG. 15B, onto the intermediate transfer film F using the equivalent or reduced size image data, that image data B is (re-) transferred to the card C (step 424). The image data B is thus formed (or printed) as a positive image to the entire surface of the card C with its four edges being cut off. Therefore, if printing to the entire surface of the card C using both transfer methods, it is necessary to prepare two types of image data having different sizes, even if the image data to be printed is the same.

With the printing apparatus 1 according to the present embodiment, by using the same size or magnifying the image data received from the PC (when determined affirmative in step 308, or at steps 312 and 320), it is possible to printing to the entire surface of the card C using a single image data regardless of the transfer method being the direct transfer method or the indirect transfer method. Therefore, with the printing apparatus 1 of the present embodiment, it is unnecessary to prepare separate image data of differing sizes for the direct transfer method or the indirect transfer method, so it is possible to ensure low running costs and high printing application. Expressed a different way, direct transfer method printers entered the market first. However, because it is possible to share image data (or because it is compatible with previous image data) used in the direct transfer method printers as image data for use on indirect transfer method printers, the costs and the labor needed to recreate the image data as new indirect transfer method image data can be eliminated.

According to the present embodiment, at steps 312 and 320, the enlargement ratio in the vertical and horizontal directions of the image data can be changed within the range of the card C vertical and horizontal size ratio when magnifying image data, as shown in FIG. 11A and FIG. 11B. Thus, it is possible to answer to both user demands. For example, if a user does not mind that circles in the images become arced, it is possible to answer their demand for ensuring as much area of the original image data as is possible in the sub-scanning direction, or it is possible to answer the user demand to use the same image shape, even if they must sacrifice some of the area.

Furthermore, according to this embodiment, blurriness or roughness in the images on the card C that occur by the magnification of the image data are eliminated using the contour enhancing process and the smoothing process, at steps 314, 316, 322 and 324. Thus, it is possible to form high quality images onto the card C even if the image data is variably magnified.

Note that this embodiment of the present invention describes an example where the average value of gradation values are calculated with the four pixels surrounding the essential pixel X as the target, as shown in FIG. 12. However, without being limited to this, it is also perfectly acceptable calculate the average values of the 8 pixel's gradation values by adding the four pixels in oblique directions, then set the essential pixel X gradation value to the average values of the 8 pixel's gradation values.

Still further, although this embodiment describes an example of forming images to one side of the card C using the direct transfer method or the indirect transfer method, it is also perfectly acceptable to form images on one side of the card C using the direct transfer method and to form images on the other side of the card C using the indirect transfer method. To perform this type of duplex printing, we shall focus on the function of the turning portion 5. Excluding step 430 in FIG. 8, after executing the indirect transfer sub-routine, the card C can be transported to turning portion 5, rotated 90° and then, in order to form images using direct transfer onto the surface opposite to that which images were formed using the indirect transfer, the following is possible. Even if executing the direct transfer process sub-routine after step 506 in FIG. 9, the indirect transfer sub-routine in FIG. 9 is executed, excluding step 524, and the indirect transfer sub-routine is executed while the card C is nipped in the turning portion 5. Then, the card C, still nipped in the turning portion 5 at step 420 in the indirect transfer sub-routine, is rotated 90° and so that it can then be transported to the transfer portion 10. Note that, in this case, after the unitized transmissive sensor S11, which is arranged near the turning portion 5 on the paired horizontal transport rollers 11 side, detects the leading edge of the card C being transported in the direction of the arrow R in FIG. 1, the CPU transports the card C a predetermined number of steps in the direction of the arrow R to nip the card in the turning portion 5.

Also, this embodiment describes the intermediate transfer film with the intermediate transfer film supply portion 16 mounted onto the supply spool shaft 120 and the intermediate transfer film take-up portion 17 mounted on the take-up spool shaft 110, but it is also perfectly acceptable to mount a hologram film supply portion onto the supply spool shaft 120, mount the hologram film take-up portion 17 onto the take-up spool shaft 110 to transfer to the card C hologram film printed continuously thereupon for security with predetermined patterns. In this case, it is also possible to share the supply spool shaft 120, but establish a take-up spool shaft for the hologram film that is separate from the take-up spool shaft 110. In such an embodiment, a signal from light receiving elements arranged on the transfer portion 10 determines the presence of the intermediate transfer film F (or the hologram film) to determine whether the image has been formed using the indirect transfer method (or described according to this example, to determine indirect transfer when the intermediate transfer film F is detected at step 310).

Also, this embodiment describes one example of the image forming portion 9 but this invention is not limited to one and can also comprise a plurality of image forming portions 9 (for example two). In this way, at one image forming portion, images can be formed on the card C, and images can be formed on the intermediate transfer film F at the other image forming portion. This further enhances printing speed while reducing errors such as entangling of the intermediate transfer sheet.

In addition, the above embodiment describes an example where image data from the PC is received and stored in the SDRAM 19B. However, it is also acceptable to store image data in SDRAM 19B via information recording media such as an FD, MO or ZIP disk.

The following shall describe in detail the second embodiment of the printing system that can applying the present invention. In this embodiment, variable magnification and gradation correction on image data is performed on a PC, then that corrected image data is sent to the printing apparatus. Note that in this embodiment, the same numbers are applied to the members that are the same as the first embodiment and any thus explanations thereof are omitted. Only the different parts are described.

As shown in FIG. 17, with this embodiment, the entire operation of the printing system 1 is executed by the CPU on the PC. Note that FIG. 17 shows the functions of the hardware, such as the CPU, ROM and RAM that comprise the PC. It shows some of the terms that correspond to the scope of the appended claims for the printing apparatus 1. The PC as the image generating device is connected to an image input apparatus, such as a scanner, that is used to load images via the interface unit. Operating command signals, and status signals indicating operating status including image data from the image input device or operating errors are communicated between the PC and image input device via the interface unit. The interface unit is the port of connection for these devices. Serial port or USB, which are representative as interfaces for receiving various types of data, such as image data are used. Connections between each of the devices are by any commonly sold cable that conforms to the interface type. Image data newly input from the image input device is stored in the image data memory unit via the interface on the PC. It is also perfectly acceptable to store to the image data memory unit the image data that has been recorded by FD or MO drives onto information recording media such as FD or MO.

The CPU operates according to the PC operating system, but it executes image data variable magnification and gradation correction according to the application software that is running on the operating system. The application software functions as the image data processing unit and image data conversion unit and the printer driver which is described below. The image data processing unit reads the image data from the image data memory unit and performs predetermined processes. Specifically, this makes the print layout using the image data that was read and character data, and combines the various types of data. Also, the image data conversion unit comprises functions that convert image data that was processed at the image data processing unit into a format that can be displayed including, for example, converting the image data to analog data), and that display the image using the image data on an image display apparatus such as a monitor and that convert RGB (light) data into CMY (colors) data for printing on the printing apparatus 1.

The printer driver unit functions as the driver section that analyzes commands for the data received from the image data conversion unit, and as the spooler section that temporarily holds data. Furthermore, it also functions as the monitor section that monitors the status of the printing apparatus 1, and as the image conversion means that converts the size of the image data that was stored in the image data memory unit that corresponds to the image printing mode.

Note that the CPU in the PC gives various instructions to the image input device or the image printing device via the interface unit, and gives instructions to the image data processing unit to compose the layout using the image data or character data that is input using the keyboard, into one image data for printing. It gives the instruction to the image data conversion unit to convert each of the various types of data described above. Also, FIG. 17 shows a portion of the printing apparatus 1, but it has the same configuration as the first embodiment.

Next, we shall describe the operation of the printing system by comparing FIG. 7 and FIG. 6 that were used in the description for the first embodiment.

In the first embodiment, part of the variable magnification and gradation offset shown in FIG. 7 was executed on the printing apparatus 1. However, in this embodiment, it is executed on the PC. Specifically, at step 302, image data input from the image input device or an information recording medium is stored in the image data memory unit. Steps 304 to 326, excluding the following two points, are executed on the PC in the same way as with the first embodiment. The first point of difference is that it is determined whether printing will be performed using indirect transfer at step 310 by communicating with the printing apparatus 1. When the operator has used input means to input the direct transfer mode or the indirect transfer mode from the touch-panel, that instruction information is communicated to the PC. The CPU can determine whether printing will proceed using indirect transfer according to that instruction information, or it is also possible to use detection information of the intermediate transfer film F (the Ribbon (Detection) shown in FIG. 17) by the light receiving element, which is arranged between the guide roller 44 and the guide plate 47, and receive that information from the control unit 19. Furthermore, it is also acceptable to use both flags at step 308 and the detection information of the intermediate transfer film F by the light receiving element that was received to raise a flag. There, if the intermediate transfer film F is not detected, then printing will use direct transfer. If there is no flag and the intermediate transfer film F is detected, then printing will use indirect transfer. The second difference is that at step 326, the transfer method and image data after correction are sent to the control unit 19 on the printing apparatus 1. It is acceptable to store these on the image data memory unit on the PC. Image data having undergone variable magnification and gradation correction, us then stored in the SDRAM 191 on the printing apparatus 1.

On the other hand, in the printing apparatus 1, the microcomputer 10A CPU on the control unit 19 executes the image forming routine shown in FIG. 6. In this case, at step 204, variable magnification and gradation correction have already been performed on the PC, so that pre-processed image data is received and stored on the SDRAM 19B.

It should be noted that even though variable magnification and gradation correction are performed on the PC in the printing system of the present embodiment, it can attain the same results as the first embodiment, which is described above. Therefore, to compare the two embodiments described above, it is possible to execute variable magnification and gradation correction on the printing apparatus 1 side or on the PC side, as long as correction is performed somewhere in the printing system.

Note that this embodiment describes an image conversion means that converts the image data size according to the image printing mode (direct transfer or indirect transfer), and that function applied in the printer driver unit on the PC (image generation device) shown in FIG. 17. However, it is also perfectly acceptable to apply that function in the application software installed on the PC. In such a case, the image data processing unit shown in FIG. 17 would have that function.

The following shall describe in detail the third embodiment of the printing system that can apply the present invention. With the print apparatus 1 of the present embodiment, it is possible to print to the entire surface of the card C using a single image data, regardless of the printing method of the direct transfer method or the indirect transfer method, by reading the image data received from the PC, and then differing the starting pixel positions to change the read out region. Also, regardless of whether printing is to proceed using the direct transfer method or the indirect transfer method, the image printed to the card C is positioned on the center of the card (called centering). Note that the same numbers are applied to the same members of both the first and second embodiments and thus any detailed explanations thereof shall be omitted.

The following shall describe the operations of the printing apparatus 1 focusing on the CPU of the microcomputer 19A in the control unit 19, in reference to the flow charts.

Note that in the descriptions above for the first and the second embodiments of the present invention, the control unit 19, shown in FIG. 5, comprises the microcomputer 19A as image conversion means and image printing mode selection means that control the printing apparatus 1. However, in this embodiment of the present invention, the control unit 19 comprises the microcomputer 19A as the print data region setting means, image forming mode selection means and the energizing control means that control the printing apparatus 1. The microcomputer 19A comprises a CPU that operates with a fast clock speed as the central processing unit, a ROM that stores with control operations for the printing apparatus 1 and an internal bus that connects the RAM and these that act as the working areas on the CPU.

The external bus 19J is connected to the microcomputer 19A. Connected to the external bus 19J are the touch-panel display operation control unit 19H that controls the display and operating instructions of the touch panel 8, the sensor control unit 19F that controls the signals from each sensor, the actuator control unit 19D that controls the motor driver for outputting the drive pulses to each motor and that controls to turn the solenoid clutches on and off, the external I/O interface 19G that communicates with the host apparatus such a PC, the buffer memory 19E that temporarily stores the image data to be printed on the card C, the thermal had control unit (the image forming control unit) 19C as the energizing control unit that controls the thermal energy of the thermal head 20 and the SDRAM (image memory) 19B as the image data memory means where image data is stored via the buffer memory 19E. The touch-panel display operation control unit 19H, the sensor control unit 19F, the thermal head control unit 19C and the actuator control unit 19D are each connected to the touch panel 8, the sensors including Sa to Sc and S1 to S11, the drivers that drive the pulse motor drivers of M1 to M3, the solenoid clutches 67 and 131, and the thermal head 20.

As shown in FIG. 18, when the power is turned on to the printing apparatus 1, the CPU can execute an image forming routine to form images on the card C using either the direct transfer method or the indirect transfer method. Initially, in the image forming routine, the system waits to receive the image data from the PC at step 602. When the image data is received, at step 604, the system then executes the image data read-out position determining sub-routine to determine the position to read out the image data.

At step 702 in FIG. 19, with this image data read out position determining sub-routine, the system initially obtains the image size in the main scanning (the shorter direction) and in the sub-scanning direction (the longer direction). It is also acceptable to obtain the image size from the header field information for the image data.

Next at step 704, the image data received from the PC is stored in the SDRAM 19B via the external I/O interface 19G and the buffer memory 19E in the order from the image data storage starting position (a predetermined address) S which is predetermined on the SDRAM 19B.

FIG. 22 shows that the data storage starting position S is always constant for storing image data received from the PC in the SDRAM 19B. Incidentally, in comparing the data storage starting position S with the monitor screen shown on a CRT, that position would be on the upper left-hand corner of the monitor screen. In the following description, the main scanning direction corresponds to the vertical direction of the image data and the sub-scanning direction corresponds to the horizontal direction of the image data, due to the positional relationship of the image data on the monitor screen and the card C. Note that in FIG. 22, the system writes the image data in the main scanning direction from the image data storage starting position S in the direction of the arrow that indicates the direction to write the image data. This conceptually shows repeating that process in the sub-scanning direction, which is the line direction. The image) data receivable region represents the maximum size that the image can be formed on the intermediate transfer film F. Therefore, the image data and printing size stored on the SDRAM 19B have the relationship of the image data receivable region≡the printing size when using indirect transfer>the printing size when using direct transfer, in the main scanning direction and the sub-scanning direction.

Next, at step 706, the system determines whether the image size is smaller than the pre-input card size (the predetermined dimensions of the card C). If negative, the system proceeds to step 710. If affirmative, a flag is raised at step 708 to indicate that the image size is the card size (the image size is the card size) and the system proceeds to step 710.

At step 710, the system determines whether to indirectly transfer the image to the card C using the image data. It is acceptable to determine that using the received mode specification signals from the PC that specify the direct transfer mode or the indirect transfer mode, or for an operator to manually input the direct transfer mode or the intermediate transfer mode using the touch-panel 8. Furthermore, it is possible for the CPU to independently determine the mode regardless of the information input from the PC or the touch-panel 8. Specifically, if the light emitting and receiving elements that are arranged between the guide roller 44 and the guide plate 47 do not detect the intermediate transfer film F, then it can determined that the mode is direct transfer and if the intermediate transfer film F is detected, it can be determined that the mode is indirect transfer.

When affirmative (or indirect transfer) at step 710, the difference (B−A) of the maximum predetermined size in the main scanning direction (the image) data receivable region) B and the image size in the main scanning direction (the writing end pixel position in the main scanning direction) A is calculated at step 712 as shown in FIG. 23A. At the next step 714, the pixel position C is calculated with the value equivalent to ½ the difference (B−A) added to the image size (the writing end pixel position in the main scanning direction) A in the main scanning direction. Through this, the range read, as the print data, from the image data read-out region in the main scanning direction when performing indirect transfer is between the pixel position demarcated by O-F and the pixel position demarcated by C-C' as the first reference position.

Next, at step 716, in the same manner as with the main scanning direction, the difference (E−D) of the maximum predetermined size (the (image) data receivable region) E in sub-scanning direction and the image size (the writing end pixel position in the sub-scanning direction) D is calculated. Then, at step 718, the pixel position F is calculated with the value equivalent to ½ the difference (E−D) added to the image size (the writing end pixel position in the sub-scanning direction) D. Through this, the range read, as the print data, from the image data read out region in the sub-scanning direction when performing indirect transfer is between the pixel position demarcated by O-C and the pixel position demarcated by F-C' as the second reference position.

At the next step 720, the intersecting pixel position C' of the first reference position C-C' and the second reference position F-C' is calculated as the print data read out starting pixel position when using intermediate transfer, and stores the transfer method (indirect transfer) and the read out starting pixel position C' (address) in RAM. It then completes the image data read out position decision sub-routine and proceeds to step 606, shown in FIG. 18.

The region read out as the print data when indirectly transferring is the region demarcated by O C C' F which is equivalent to the size of the image data receivable region in this embodiment. The direction that is read out is the opposite to the direction written to the SDRAM 19B using the read out starting pixel position C' as the starting point (see FIG. 22 and FIG. 23A). As describe below, mirrored images are formed on the intermediate transfer film F using the image data of the region demarcated by O C C' and F. Those mirrored images on the intermediate transfer film F are transferred to the card C so the images formed on the card C are positive. Although read out as the image data in the region demarcated by O C C' F and S A A' D, the actual image data does not exist. In this region, thermal energy is energized to the thermal head 20 by the thermal head control unit (image forming control unit) 19C that does not sublimate or meltingly transfer the thermal transfer ink on the thermal transfer film R. For example the zero gradation energizing as described in Japanese laid open patent Tokkaihei 7-125293 is executed to energize the thermal energy.

Note that when the image data received from the PC is the same maximum size as the image data receivable region, as shown in FIG. 23B, the same routines as in steps of 712 to 720 are executed. Because the difference of both the main scanning direction (in the vertical direction) and the sub-scanning direction (in the horizontal direction) is 0, a mirrored image is formed on the intermediate transfer film F by reading out direction opposite to the direction that image data size was written to the SDRAM 19B. Then, the positive image is transferred to the card C, but the four corners of the image data are cut. It is not common to place important information relating to a person near the corners. Rather, it is more common to have background images at the corners when printing to the entire surface, so when the corners are cut off, the problems described below do not occur.

On the other hand, when negative (or direct transfer) at step 710, the difference of the image size in the main scanning direction (the (image data receivable region) represented by C-B, and the card size in the main scanning direction represented by S-A is calculated at step 722 as shown in FIG. 24A. At the next step 724, the pixel position A is calculated with the value equivalent to ½ the difference (B−A) subtracted from the image size (the writing end pixel position in the main scanning direction) B in the main scanning direction. The range that is read, as the print data in the main scanning direction when performing direct transfer, from the image data read out region is the pixel position demarcated by A-A' as the first reference position.

Next at step 726, in the same way as with the main scanning direction, the difference of the image size (the (image) data receivable region) in the sub-scanning direction represented by C-C', and the card size in the sub-scanning direction represented by S-S' is calculated. A value equivalent to ½ the difference is subtracted from the pixel position C which is the position to start writing image data in the sub-scanning direction to SDRAM 19B to calculate the pixel position S. The range read from the image data read out region as the print data in the sub-scanning direction when performing direct transfer is the pixel position demarcated by S-A' as the second reference position.

At step 720, the intersecting pixel position A of the first reference position A-A' and the second reference position S-A' is determined as the print data read out starting pixel position when using direct transfer. The system stores the transfer method (direct transfer) and the read out starting pixel position A and read out ending pixel position S' (addresses) in RAM. It then completes the image data read out position decision sub-routine and proceeds to step 606, shown in FIG. 18.

The region read out as the print data when directly transferring is the region demarcated by A S S' A which is equivalent to the card size of the image data receivable region in this embodiment. The direction that is read out is the same direction written to the SDRAM 19B using the read out starting pixel position A as the starting point (see FIG. 22 and FIG. 24A). What is meant here by the same direction is that the writing direction and the read out direction in the sub-scanning direction which is a line direction, are the same. In the main scanning direction, as is clear in comparing FIG. 22 and FIG. 24A, left and right are opposite directions. That means that the reference for energizing the thermal head 20, in other words, the order for print data to be sent is left edge of the FIG. 24A. In direct transfers, images are formed on the card C in positive form using the image data in the region demarcated by A S S' A' with the region set as the print data (the image data read out region) being the same as the card size.

Note that FIG. 24A shows an example of when the image data received from the PC is larger than the card size, but as shown in FIG. 24B, when the image data received from the PC is smaller than the card size, in the same way as was described for the indirect transfer method, the difference is 0 so positive images are formed on the card C using the image data (B C C' B') received.

At step 206 in FIG. 18, the system waits until the printing start instruction from either the PC or the touch-panel 8. When the instruction is received, at step 608, it determines whether the transfer method stored in RAM at step 720 is for indirect transfer. If affirmative, at step 610, the indirect transfer process sub-routine is executed to form the images on the card C using the indirect transfer method.

As shown in FIG. 20, at step 802 in the indirect transfer process sub-routine, the pulse motors M1 and M2 rotate in the feed direction (Fw). At step 804, the mark for positioning formed on the intermediate transfer film F is recognized by monitoring the light reception sensor S2. It is determined whether the intermediate transfer film F has been transported to the printing starting position by detecting the amount of rotation of the clock plate 90 which is connected to the back-tension roller 88 that constantly reversibly rotates as a single unit with the feeding and returning of the intermediate transfer film F. If negative, the system returns to step 802 and continues transporting the intermediate transfer film F. If affirmative, the drive of the pulse motors M1 and M2 are turned off at the next step 806. During that time, the thermal head 20 is positioned away from the platen roller 21 and the starting edge of for example Y (yellow) on the thermal transfer film R is fed a predetermined distance to the printing position Sr. Such control is executed by detecting the trailing edge of the Bk (black) portion on the thermal transfer film R using the light emitting sensor S4, and by detecting the rotation of the clock plate, not shown in the drawings, established near the paired take-up rollers 57 using the unitized transmissive sensor, not shown in the drawings, that detects the distance from the trailing edge of the Bk (black) portion having a predetermined width on the thermal transfer sheet R, to the Y (yellow) portion on the thermal transfer sheet R.

Next, at step 808, the thermal head sliding cam 23 is rotated in the direction of the arrow A to touch the thermal head 20 against the platen roller 21 interposed therebetween by the thermal transfer film R and the intermediate transfer film F. Next, at step 810, while rotating the pulse motor M1 and the pulse motor M2 in the take-up (Rv) direction, the platen roller 21 is rotated in the counterclockwise direction by interlocking the solenoid clutches 67 and 131. This rotates the transport roller 58 in the counterclockwise direction. This starts the forming of the image using the color Y (yellow) on the intermediate transfer film F. In other words, the thermal head 20 heats the Y (yellow) ink layer on the thermal transfer film R, thereby starting to form the image on the receptive layer Fe on the intermediate transfer film F. The driving force provided by the pulse motor M1 rotates the platen roller 21 in the counterclockwise direction and the driving force of the pulse motor M2 takes up the intermediate transfer film F using the intermediate transfer film supply portion 16. In synchronization to that, the thermal transfer film R is taken up by the thermal transfer film take-up portion 15.

At step 812, by determining whether the pulse motor M1 has rotatingly driven a predetermined number of pulses that correspond to the size of the length direction of the image formed on the intermediate transfer film F, it is determined whether the forming of the image on the intermediate transfer film F has been completed. When it is negative, the system returns to step 810 and continues forming the image on the intermediate transfer film F. If affirmative, along with turning off the drive of both the pulse motor M1 and M2 at the step 814, it releases the interlock of the solenoid clutches 67 and 131 on the platen roller 21 and transport roller 58. Note that the CPU converts the image data of the region demarcated by O C C' F in the SDRAM 19B and sends to the thermal head 20 the mirrored image data with predetermined coefficients applied to the thermal energy according to the intermediate transfer film F via the thermal head control unit (image forming control unit) 19C for each line (or a plurality of lines) in the direction opposite to the direction that it was written to the memory, using the read out starting pixel position C' as the starting position. The printing elements of the thermal head 20 are heated according to this printing data.

At step 816, the thermal head sliding cam 23 rotates to retract the thermal head 20 from the platen roller 21 and at step 818, it is determined whether the forming of the image for the prescribed colors (YMC) has been completed. If negative, the system returns to step 802 to form the image overlaying the color already formed on the receptive layer on the intermediate transfer film F (for example, Y) with the next color (for example, M). If affirmative, in other words, if it is determined that the forming of the image using the colors YMC has been completed, the system proceeds to step 820. This forms a mirror image of a size larger than the card C on the intermediate transfer film F.

At the next step of 820, the pulse motor M2 is driven to transport the intermediate transfer film F to the heat roller 45 position which is separated from the platen roller 50 in advance, according to the amount of rotation of the clock plate mounted onto the back-tension roller 88. When transporting, it possible at this point to reset the amount of transport to improve the transporting accuracy of the intermediate transfer film F by monitoring output from the light receiving sensor arranged between the guide roller 44 and the guide plate 47 in the transfer portion 10 and detecting the mark for positioning the intermediate transfer film F. Also, at step 820, in parallel to transporting the intermediate transfer film F to the transfer portion 10, the card C is feed from the card supply portion 3 along the second card transport path P2 until the leading edge thereof touches the heat roller 45. Specifically, while rotatingly driving the card supply portion 3, the cleaner 4 and the pinch rollers 38 and 39 on the turning portion 5, the pulse motor M3, not shown in the drawings, drives to rotate the paired horizontal transport rollers 11, the paired transport rollers 48 and each of the rollers on the horizontal transport portion 12. This sends one card C from the card supply portion 3 to the second card transport path P2 where both surfaces of the card C are cleaned by the cleaner 4. When the unitized transmissive sensor S5, not shown in the drawings, detects the leading edge of the card C, it stops the rotation of the kick roller 31. Continuing, the card C is transported further in the direction of the arrow L through the turning portion 5 along the second card transport path P2. When the unitized transmissive sensor S7, not shown in the drawings, arranged on the paired horizontal transport rollers 11 side near the transport roller 48 detects the leading edge of the card C, the card is transported further a determined number of pulses in the direction of the arrow L. This transports the card C to a position where the leading edge touches the heat roller 45. Note that the point at which the unitized transmissive sensor S8, not shown in the drawings, detects the leading edge of the card C, the rotational drive of the pinch rollers 38 and 39 is turned off.

Next, at step 822, the heat roller elevator cam 51 is rotated in the direction of the arrow B which shifts the heat roller 45 from being separated from the platen roller 50 (see FIG. 14A) to touching the platen roller 50 (see FIG. 14B), then the rotation of the heat roller elevator cam 51 stops rotating. At this point, the leading edge of the card C touches the heat roller 45, while a side of the card C is supported by the platen roller 50 and the intermediate transfer sheet F is interposed between the other side of the card C and heat roller 45.

Next, at step 824, the system executes an indirect transfer that thermally transfers images formed on the reception layer Fe of the intermediate transfer film F to one side of the card C at the image forming portion 9 using the heat and pressure of the heat roller 45. To describe the operations that occur here at step 824 in more detail, the card C, the other side thereof supported by the platen roller 50 that rotates in the counterclockwise direction, is touched to the heat roller 45 with one surface interposed by the intermediate transfer film F and is transported in the direction of the arrow L. The peeling layer Fc on the intermediate transfer film F is peeled away from the base film Fa by the heat of the heating lamp 46 and through the pressure of the heat roller 45. The layer Fe formed thereupon with images and the overcoat layer are transferred to the other side of the card C as a single body. In synchronization to this transfer, the intermediate transfer film F is taken up by the intermediate transfer film take-up portion 17. During this time, at step 826, by monitoring whether or not the leading edge of the card C is at the unitized transmissive sensor S9 arranged on the paired discharge roller 142 side near the paired rollers that have no drive arranged between the capstan rollers 141 and the paired discharge rollers 142, the system determines whether indirect transfer has been completed. If not completed, it returns to step 824 and continues the indirect transfer. If indirect transfer has been completed, it proceeds to the next step of 828. Images are formed with the positive image to the entire surface (all areas) of the card C through the transfer that occurs at the transfer portion 10. Note that the transport of the card C and the intermediate transfer film F during indirect transfer are the same speed.

At step 828, by stopping the drive of the pulse motors M2 and M3, the feeding transport of the intermediate transfer film F (rewinding to the intermediate transfer film take-up portion 17) and the transport of the card C in the direction of the arrow L are stopped. The heat roller elevator cam 51 is re-rotated to retract the heat roller 45 from the platen roller 50. Then, at step 830, the system executes the transport/discharge process that transports the card C to the second card transport path P2 and discharges it outside of the printing apparatus 1.

In the transport/discharge process that is performed at step 830, the pulse motor M3, not shown in the drawings, drives to transport the card C further in the direction of arrow L along the second card transport path P2. It is determined whether the unitized transmissive sensor S10, not shown in the drawings, arranged between the horizontal transport portion 12 and the discharge outlet 27 has detected the leading edge of the card C. If negative, the card is transported further. If affirmative, transport continues for a predetermined amount of time to completely discharge the card C outside of the frame 2. This discharges the card C to the stacker 13 via the discharge outlet 27. Next, the rotational drive of the pulse motor M3, not shown in the drawings, is stopped and the pulse motors M1 and M2 are driven in reverse. It is determined by the unitized transmissive sensor SA, described above, whether the intermediate transfer film F has been transported the predetermined distance. If negative, the system continues to transport the intermediate transfer film F. If affirmative, the system stops the drives of the pulse motors M1 and M2, completes the indirect transfer sub-routine and returns to step 602.

If the decision is affirmative (direct transfer) at step 608 in FIG. 18, the direct transfer sub-routine for forming images on the card C using the direct transfer method is executed at step 612.

As shown in FIG. 21, with the direct transfer routine at step 902, the card supply portion 3 arranged on the second card transport path P2, the cleaner 4 and each of the rollers on the turning portion 5 operate to transport the card C from the card supply portion 3 in the direction of the arrow L whereat the card C is nipped by the pinch rollers 38 and 39 in the turning portion 5. In other words, by rotating the kick roller 31 on the card supply portion 3, the bottommost card C in the card stacker is fed to the second card transport path P2 whereat both sides of the card C are cleaned by the cleaning roller 34 on the cleaner 4. When the leading edge of the card C has been detected by the unitized transmissive sensor S5, not shown in the drawings, arranged between the cleaner 4 and the transfer portion 5, the rotation of the kick roller 31 on the card supply portion 3 is stopped. The card C is stopped after it is transported a predetermined number of pulses after passing the position where it was detected by the unitized transmissive sensor S5 to the turning portion 5 (the rotational drive of the pinch rollers 38 and 39 is also stopped) and the horizontally positioned turning portion 5 nips both ends of the card C.

Next, at the step 904, the turning portion 5 is rotated 90° to become vertically oriented (see the dotted lines in FIG. 1) to transport the card C in the direction of the arrow U over the first card transport path P1. Next, at step 906, while rotatingly driving the pinch rollers 38 and 39, the rotating drive of the pulse motor M1 starts to the pulse motor M1 motor driver while the solenoid clutch 67 transmits drive force from the pulse motor M1 to the platen roller 21. Through this, the rotational drive of the pinch rollers 38 and 39, the platen roller 21, and the capstan rollers 74 and 78 is started to begin the transport of the card C to the image forming portion 9 along the first card transport path P1. Also, the transport is started for the intermediate transfer film F toward the intermediate transfer film supply portion 16 (to be rewound).

At the next step 908, the system determines whether the unitized transmissive sensor S7, not shown in the drawings, arranged between the capstan roller 78 and the thermal head 20 has detected the leading edge of the card C. If negative, it returns to the step 906 and continues the transport of the card C to the image forming portion 9. If affirmative, at step 910, it transports the card C in the direction of arrow U a predetermined number of pulse until the leading edge of the card C reaches the printing position Sr. The pinch rollers 38 and 39 on the turning portion 5 stop rotating at the point where the unitized transmissive sensor S6, not shown in the drawings, arranged between the turning portion 5 and the image forming portion 9, detects the trailing edge of the card C. During that time, the thermal head 20 is positioned away from the platen roller 21 (see FIG. 13A) and the starting edge of Bk (black) of the thermal transfer film R is fed a predetermined distance to the printing position Sr. Next, at step 910, the rotation of the thermal head sliding cam 23 is started in the direction of arrow A. This supports the other side of the card C at the platen roller 21 interposed by the intermediate transfer film F. One side touches the thermal head 20 interposed by the thermal transfer film R.

Continuing, at step 912, images are formed on one side of the card C using the direct transfer method. As shown at FIG. 24A, the CPU converts the image data of the region demarcated by A S S' A' (or in the case of FIG. 24B, B C C' B') in the SDRAM 19B and sends to the thermal head 20 the positive image data with predetermined coefficients applied to the thermal energy according to type of card C, via the thermal head control unit (image forming control unit) 19C for each line (or a plurality of lines) in the same direction as was written to the memory, using the read out starting pixel position A (or in the case of FIG. 24B, the pixel position B). The printing elements of the thermal head 20 are heated according to this printing data. The pulse motor M1 drive rotates the platen roller 21 in the counterclockwise direction. In synchronization to that, the thermal transfer film R is taken-up by the thermal transfer film take-up portion 15 and images, such as cautions for use, are formed (printed) to one side of the card C in Bk (black) using the direct transfer method. This forms positive images to the entire surface (all areas) of the card C. Note that the intermediate transfer film F is transported at the same speed as the thermal transfer film R and the card C.

At the next step 914, the thermal head sliding cam 23 is rotated in the direction opposite to the arrow A to retract the thermal head 20 from the card C. At step 916, after reversingly driving the pinch rollers 38 and 39, the reverse drive of the pulse motor M1 is started to reversingly rotate the platen roller 21 and the capstan rollers 74 and 78, thereby transporting the card C in the direction of the arrow D.

At step 918, the system determines whether the trailing edge of the card C has been transported to the position of the unitized transmissive sensor S6, which is not shown in the drawings. If it is determined to be negative, the system returns to step 916 and continues to transport the card C in the direction of the arrow D. If affirmative, at the next step 920, it transports the card C a predetermined number of pulses further in the direction of the arrow D. Next, at step 922, when the drive of the pulse motor M1 is stopped, the system the interlock to the platen roller using the solenoid clutch 67. The reverse rotation of the pinch rollers 38 and 39 in the vertically oriented turning portion 5 is stopped to nip both edges of the card C therein. At step 924, the system executes the transport/discharge process to transport the card C over the second card transport path to outside of the printing apparatus 1.

In the transport/discharge process at step 924, the vertically oriented turning portion 5 is rotated 90° to allow the card C positioned on the first card transport path P1 to be transported in the direction of the arrow L on the second card transport path P2. This positions the card C with the other side facing upward, on the second card transport path P2. Next, the pulse motor M3, which is not shown in the drawings, drives to transport the card C further in the direction of arrow L along the second card transport path P2. The system determines whether the unitized transmissive sensor S10, which is not shown in the drawings, arranged between the horizontal transport portion 12 and the discharge outlet 27 has detected the leading edge of the card C. If negative, the card is transported further. If affirmative, transport continues for a predetermined amount of time to completely discharge the card C outside of the frame 2. The rotating drive of the pulse motor M3 is turned off, the direct transfer sub-routine is completed and the system returns to step 602. This discharges the card C to the stacker 13 via the discharge outlet 27. Note that the point at which the unitized transmissive sensor S8, not shown in the drawings, detects the leading edge of the card C, the rotational drive of the pinch rollers 38 and 39 is turned off. Also, in direct transfer, as shown in FIG. 14A, the heat roller 45 on the transfer portion 10 remains separated from the platen roller 50.

The printing apparatus 1 of the present embodiment prints a positive image to the entire surface of the card C by directly transferring the thermal sublimate ink on the thermal transfer film R. Specifically, as shown in FIG. 15A, the system forms (prints) positive images to the entire surface of the card C by thermally transferring images according to the image data A which the same size as the card C. On the other hand, to print over the entire surface of the card C using indirect transfer, the intermediate transfer film F reduces from the heat at the image forming portion 9. Also, the positioning with the card C to which the images are to be finally formed is extremely difficult (precise transport) because the intermediate media of the intermediate transfer film F is an added process. Therefore, after forming a mirrored image of the image data B (steps 802 to 818) generated with a size larger than the card C, as shown in FIG. 15B, onto the intermediate transfer film F using the image data B is (re-) transferred to the card C (step 824). The image data B is thus formed (or printed) as a positive image to the entire surface of the card C with its four edges cut off. Therefore, if printing to the entire surface of the card C using both transfer methods, it is necessary to prepare two types of image data having different sizes, even if the image data to be printed is the same. Also, it is necessary to center the data, if sharing that image data for both the direct transfer method and the indirect transfer method.

With the printing apparatus 1 according to the present embodiment, by varying the read out starting pixel position to change the read out region of the image data received from the PC (step 712 to step 720, and step 722 to step 2 and 720), it is possible to printing to the entire surface of the card C using a single image data regardless of the transfer method being the direct transfer method or the indirect transfer method (step 610 and step 612). Also, adding or subtraction ½, to position the image to be printed on the card C on the center of the carrier 6 (called centering), the image data read out starting position can be varied, regardless of the direct transfer method or the indirect transfer method. Therefore, according to this embodiment, if it is determined that the image data is smaller than the card size, the system uses the card size as the reference position to calculate the read out starting position for the purpose of centering the image data, and then sets the read out starting position between the card size and the data receivable region edge (to be read out in the card size when using the direct transfer method). Furthermore, when the mirrored image is formed on the intermediate transfer film F and then a positive image is transferred to the card C, the four corners of the image data are cut, but because a centering process has been performed, no problems occur in the final image. Therefore, with the printing apparatus 1 of the present embodiment, it is unnecessary to prepare separate image data of differing sizes for the direct transfer method or the indirect transfer method, so it is possible to ensure low running costs and high printing application. Expressed a different way, direct transfer method printers entered the market first. However, because it is possible to share image data (or because it is compatible) used in the direct transfer method printers as image data for use on indirect transfer method printers, the costs or the labor for recreating the image data as new indirect transfer method image data can be eliminated.

Still further, with the printing apparatus 1 of the present embodiment, the image is used at its size without having to variably magnify (enlarge or reduce) the image data stored in the SDRAM 19B so gradation correction of the pixels for enhancing or alleviating, which is required when performing variably magnify, are unnecessary, thereby making it possible to form (or print) high quality images on the card C. Also, when varying the read out starting pixel position to change the read out range, a zero gradation energizing is performed when required, so it is possible to hold down the thermal gap between the zero gradation energizing region and image data region. This enables a quality peeling of the intermediate transfer film F.

Still further, although this embodiment provides an example of forming images to one side of the card C using the direct transfer method or the indirect transfer method, it is also perfectly acceptable to form images on one side of the card C using the direct transfer method and to form images on the other side of the card C using the indirect transfer method. To perform this type of duplex printing, we shall focus on the function of the turning portion 5. Excluding step 830 in FIG. 8, after executing the indirect transfer sub-routine, the card C can be transported to turning portion 5, rotated 90° and then, in order to form images using direct transfer onto the surface opposite to that which images were formed using the indirect transfer, the following is possible. Even if executing the direct transfer process sub-routine after step 906 in FIG. 21, after the indirect transfer sub-routine, excluding step 924, shown in FIG. 21 is executed, the indirect transfer sub-routine is executed while the card C is nipped in the turning portion 5. Then, the card C, still nipped in the turning portion 5 at step 820 in the indirect transfer sub-routine, is rotated 90° so that it can then be transported to the transfer portion 10.

Also, this embodiment describes the intermediate transfer film with the intermediate transfer film supply portion 16 mounted onto the supply spool shaft 120 and the intermediate transfer film take-up portion 17 mounted on the take-up spool shaft 110, but it is also perfectly acceptable to mount a hologram film supply portion onto the supply spool shaft 120, mount the hologram film take-up portion 17 onto the take-up spool shaft 110 to transfer to the card C hologram film printed continuously thereupon for security with predetermined patterns. In this case, it is also possible to share the supply spool shaft 120, but establish a take-up spool shaft for the hologram film which is separate from the take-up spool shaft 110. In such an embodiment, a signal from light receiving elements arranged on the transfer portion 10 determined the presence of the intermediate transfer film F (or the hologram film) to determined whether the image has been formed using the indirect transfer method (or described according to this example, to determine indirect transfer when the intermediate transfer film F is detected at step 710).

Also, this embodiment describes one example of the image forming portion 9 but this invention is not limited to one and can also comprise a plurality of image forming portions 9 (for example two). In this way, at one image forming portion, images can be formed on the card C, and images can be formed on the intermediate transfer film F at the other image forming portion. This further enhances printing speed while reducing errors such as entangling of the intermediate transfer sheet.

In addition, the above embodiment describes an example where image data from the PC is received and stored in the SDRAM 19B. However, it is also perfectly acceptable to store image data in SDRAM 19B via information recording media such as an FD, MO or ZIP disk. Also, description of the embodiment above is for one image data receivable region, in FIG. 22 to FIG. 24A and FIG. 24B, in order to simplify the explanation. However, it can go without saying that it is also perfectly acceptable to have a plurality of image data receivable regions and for this invention to still be applicable. If a plurality of image data receivable regions are established in the SDRAM 19B, it is preferable that an image data ID or name is also stored in RAM at step 720.

Thus, as described above, according to this invention, the image data size is varied and the image is printed to the entire surface of at least one side of either the first recording medium or the second recording medium so it is possible to print to the entire surface of the recording medium by switching between the direct transfer method and the indirect transfer method. Because there is no need for image data that is of a different size for the first image printing mode and the second image printing mode, it is possible to provide a printing method that has a low running cost and high printing applicability.

Also, according to this invention, images are printed to the entire surface of at least one side of either the first recording medium or the second recording medium based on the same image data. It is possible to print to the entire surface of the recording medium by switching between the direct transfer method and the indirect transfer method and because there is no need to prepare image data having a different size for the first image printing process and the second image printing process, it is possible to provide a printing method that has a low running cost and high printing applicability.

Note that according to the invention, the printing apparatus 1 comprises an image forming portion 9 that forms images on a card C or onto the intermediate transfer film F, and a transfer portion 10 that transfers images formed on the intermediate transfer film F to the card C, so as illustrated with the image forming routine, it is possible to print using both of the direct transfer method and indirect transfer method. Furthermore, because it is possible to freely print using direct transfer or indirect transfer to one surface or both surfaces, the conveniences is further enhanced for printer users.

What we claim is:

1. A printing method comprising:

a first image printing mode that transports a first recording medium to an image forming position and forms an image to the entire surface of one side of said first recording medium at said image forming position;

a second image printing mode that transports an intermediate transfer medium that temporarily holds an image to said image forming position and transports a second recording medium or said first recording medium to an image transfer position while transporting said intermediate transfer medium to said image transfer portion after forming said image on said intermediate transfer medium at said image forming position, and that transfers said image formed on said intermediate transfer medium to the entire surface of one side of a second recording medium or the other side of said first recording medium at said image transfer position;

wherein image data size is varied according to said first image printing mode or said second image printing mode to form an image, and prints an image to the entire surface of at least one side of said first recording medium or said second recording medium.

2. The printing method according to claim 1 that varies said image data size according to detection information of said intermediate transfer film and/or instruction information that specifies said image printing mode.

3. The printing method according to claim 2 that prints to the entire surface of at least one side of the first recording medium either with the same size as the image data or reduces the size of the image data, when said first image printing mode is selected.

4. The printing method according to claim 3 that calculates the average gradation value of a plurality of pixels in a predetermined vicinity for each pixel in reduced image data and sets the calculated average gradation value to the gradation value for said pixel, when reducing said image data and forming an image.

5. The printing method according to claim 2 that forms an image on said intermediate transfer medium with the same size as said image data or enlarged size of said image data, then transfers the formed image to the entire surface of at least one side of said second recording medium, when said second image printing mode is selected.

6. The printing method according to claim 5 that finds the predetermined point of variation from the amount of change in the gradation value between adjacent pixels for each pixel in enlarged image data and increases or decreases said gradation value of the said pixel at the point of variation in order to vary the amount of change of gradation values of adjacent pixels, when enlarging said image data and forming an image.

7. The printing method according to claim 5 that calculates the average gradation value of a plurality of pixels of a predetermined vicinity for each pixel in enlarged image data to find the difference of the calculated average gradation value and the gradation values of said pixel, and sets the gradation value for the said pixel by adding or subtracting said difference to said gradation values for said pixel, when enlarging said image data and forming an image.

8. The printing method according to claim 1 that variably sets the variable magnification ratio for the vertical and horizontal sizes of said image data within the range of vertical and horizontal size ratio of either said first recording medium or said second recording medium, when varying said image data size and forming an image.

9. A printing system comprising an image generating apparatus for generating images and an image printing apparatus for printing images generated by said image generating apparatus, wherein:

said image printing apparatus comprises at least one printing means for selectively forming an image to a recording medium and to an intermediate transfer medium that temporarily holds images via thermal transfer film that having an ink layer, and transfer means for transferring an image formed on said intermediate transfer medium to said recording medium or to a different recording medium; and image variable magnification means for varying the magnification of the image data size according either to the first image printing mode that forms an image to the entire surface of at least one side of said recording medium using said printing means, or to said second image printing mode that transfers an image to the entire surface of at least one side of said recording medium or a different recording medium thereupon formed with an image from said intermediate transfer medium using said transfer means after said printing means forms an image onto said intermediate transfer medium.

10. The printing system according to claim 9 that calculates the average gradation value of a plurality of pixels in a predetermined vicinity for each pixel in reduced image data and sets the calculated average gradation value to the gradation values for said pixel, when reducing said image data size and forming an image.

11. The printing system according to claim 9, wherein said image variable magnification means finds the predetermined point of variation from the amount of change in the gradation value between adjacent pixels, for each pixel in enlarged image data and increases or decreases said gradation value of said pixels at the point of variation in order to vary the amount of change of gradation values of adjacent pixels, when reducing said image data size and forming an image.

12. The printing system according to claim 9, further comprising image printing mode selection means for selecting either one of said first image printing mode or said second image printing mode, wherein said image printing mode selection means determine and select either of said first image printing mode or said second image printing mode according to the detection information of the intermediate transfer medium and/or a manually set image printing mode setting signal and/or instruction information from said image generating apparatus.

13. The printing system according to claim 12, wherein said image variable magnification means perform a magnifying process to variably set the enlarging ratio of said image data in the vertical and horizontal size ratio within the range of the vertical and horizontal size ratio of said recording medium, when said second image printing mode is selected by said image printing mode selection means.

14. A printing method comprising:

a first image forming process that transports a first recording medium to an image forming position and forms an image to the entire surface of one side of said first recording medium at said image forming position;

a second printing process that transports an intermediate transfer medium that temporarily holds an image to said image forming position and transports a second recording medium or said first recording medium to an image transfer position while transporting said intermediate transfer medium to said image transfer portion after forming an image on said intermediate transfer medium at said image forming position, and that transfers said image formed on said intermediate transfer medium to the entire surface of one side of a second recording medium or the other side of said first recording medium at said image transfer position;

and that prints an image to the entire surface of at least one side of said first recording medium and/or said second recording medium based on one image data, in said first image printing process or said second image printing process.

15. The printing method according to claim 14, wherein an image of said image data and an image printed by said first image printing process or said second image printing process are the same magnification.

16. The printing method according to claim 15 that obtains the sizes of said image data in the vertical and horizontal directions, determines either said first printing process or said second printing process and determines the image data read out position for forming an image on said first recording medium or said intermediate transfer medium.

17. The printing method according to claim 16 that determines said image data read out position by setting a reference position in a line using single pixel as units for both the vertical direction and the horizontal direction of the image data.

18. The printing method according to claim 17 that calculates the vertical direction difference between the size of said image data in said vertical direction and the maximum can predetermined size that an image be formed in a first direction on said intermediate transfer medium corresponding to said vertical direction, and uses the pixel position thereto added ½ of said difference in the vertical direction to pixel position where writing to memory ended in the vertical direction, as an image data first read out reference position for forming an image on said intermediate transfer medium, when said second printing process is selected.

19. The printing method according to claim 18 that calculates the horizontal direction difference between the size of said image data in said horizontal direction and the maximum predetermined size that an image can be formed in a second direction on said intermediate transfer medium in said horizontal direction, and uses the pixel position thereto added ½ of said difference in the horizontal direction to pixel position where writing to memory ended in the horizontal direction, as an image data second read out reference position for forming an image on said intermediate transfer medium.

20. The printing method according to claim 19 that sets an intersecting point of said first read out reference position and said second read out reference position as an image data read out starting position for forming an image on said intermediate transfer medium.

21. The printing method according to claim 20 that forms a mirror image on said intermediate transfer medium by reading out image data read from said image data read out starting position in a direction reverse to a direction that said image data was written into the memory.

22. The printing method according to claim 16, wherein either of said first image printing process or said second image printing process is determined according to detection information of said intermediate transfer medium, and/or the instruction information that specifies either said first or said second image printing process.

23. The printing method according to claim 17, that calculates the vertical direction difference between the size of said image data in said vertical direction, and the size in a first direction on said first recording medium in said vertical direction, and uses the pixel position therefrom subtracted ½ of said difference in said vertical direction to a pixel position where writing to memory ended in said vertical direction, as a image data first read out reference position for forming an image on said first recording medium, when said first printing process is selected.

24. The printing method according to claim 23, that calculates the horizontal direction difference of the size of said image data in said horizontal direction, and the size in the second direction on said first recording medium in said horizontal direction, and uses the pixel position therefrom subtracted ½ of said difference in said horizontal direction to a pixel position where writing to memory started in said horizontal direction, as the image data second read out reference position for forming an image on said first recording medium.

25. The printing method according to claim 24 that sets an intersecting point of said first read out reference position and said second read out reference position as an image data read out starting position for forming an image on said first recording medium.

26. The printing method according to claim 25 that forms a positive image on said first recording medium by reading out image data read from said image data read out starting position in the same direction as the image data was written into said memory.

27. A printing apparatus comprising:

at least one printing means that selectively prints an image to a recording medium and to an intermediate transfer medium that temporarily holds said image via thermal transfer film that comprises an ink layer;

transfer means for transferring said image formed on said intermediate transfer medium to said recording medium or to a different recording medium;

image data storing means for storing image data;

print data region setting means that obtains the vertical direction and the horizontal direction sizes for image data stored in said image data storage means, calculates difference between obtained size and a predetermined size of said recording medium or a maximum predetermined size that an image can be formed on said intermediate transfer medium, adds or subtracts ½ of said difference calculated for the image data read out starting position written to said image data storage means or an ending position and sets a print data read out starting position for forming an image; and image forming mode selection means that selects one of either of a first image forming mode for forming an image to an entire surface of at least one side of said recording medium using said printing means, or a second image forming mode that forms an image to said intermediate transfer medium using said printing means;

wherein said print data read out starting position is varied by setting said print data region setting means according to said first or said second image forming mode selected by said image forming mode selection means.

28. The printing apparatus according to claim 27, wherein said print data region setting means sets the reference position to determine said print data read out starting position to read out print data in both the vertical direction and horizontal direction of image data read out from said image data storage means.

29. The printing apparatus according to claim 28, further comprising energizing control means for energizing said printing means using the pixel position located at the intersecting point on the reference positions set for both the vertical direction and horizontal direction of said image data, as a reference for the print data read out starting position.

* * * * *